US011680459B1

(12) United States Patent
Al-Ramadhan

(10) Patent No.: US 11,680,459 B1
(45) Date of Patent: Jun. 20, 2023

(54) LINER SYSTEM WITH INTEGRATED CEMENT RETAINER

(71) Applicant: Saudi Arabian Oil Company, Dhahran (SA)

(72) Inventor: Ahmed A. Al-Ramadhan, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/679,825

(22) Filed: Feb. 24, 2022

(51) Int. Cl.

| | |
|---|---|
| ***E21B 33/14*** | (2006.01) |
| ***E21B 23/06*** | (2006.01) |
| ***E21B 34/14*** | (2006.01) |
| ***E21B 23/03*** | (2006.01) |

(52) U.S. Cl.
CPC ..... *E21B 33/14* (2013.01); *E21B 23/03* (2013.01); *E21B 23/06* (2013.01); *E21B 34/14* (2013.01); *E21B 2200/06* (2020.05)

(58) Field of Classification Search
CPC ..... E21B 33/00
See application file for complete search history.

(56) References Cited

U.S. PATENT DOCUMENTS

| | | | |
|---|---|---|---|
| 462,431 | A | 11/1891 | McMullin |
| 1,896,482 | A | 2/1933 | Crowell |
| 1,949,498 | A | 3/1934 | Frederick et al. |
| 2,121,002 | A | 6/1938 | Baker |
| 2,189,697 | A | 3/1939 | Baker |
| 2,187,487 | A | 1/1940 | Burt |
| 2,222,233 | A | 11/1940 | Mize |
| 2,327,092 | A | 8/1943 | Botkin |
| 2,672,199 | A | 3/1954 | McKenna |
| 2,806,532 | A | 9/1957 | Baker |
| 3,116,799 | A | 1/1964 | Lemons |
| 4,190,112 | A | 2/1980 | Davis |

(Continued)

FOREIGN PATENT DOCUMENTS

| | | |
|---|---|---|
| GB | 958734 | 5/1964 |
| WO | WO 2017043977 | 3/2017 |
| WO | WO 2018017104 | 1/2018 |

OTHER PUBLICATIONS

Bruton et al., "Whipstock Options for Sidetracking," Oilfield Review, 26(1), Spring 2014, 10 pages.

*Primary Examiner* — William D Hutton, Jr.
*Assistant Examiner* — Avi T Skaist
(74) *Attorney, Agent, or Firm* — Fish & Richardson P.C.

(57) ABSTRACT

A system includes an integrated liner hanger assembly that includes a liner hanger, a packer, and a cement retainer sub. The cement retainer sub includes a plurality of fluid passageways connecting a central bore of the liner hanger assembly to an annular volume downhole of the packer and uphole of the liner hanger. A running tool is configured to axially translate a sliding sleeve of the cement sub from a closed position to an open position in which flow if permitted through the passageways, and from the open position to a closed-and-locked position. In some embodiments, the system is configured such that running the assembly into the wellbore, actuating the liner hanger, actuating the packer assembly, translating the sliding sleeve from the closed and open position and from the open position to the closed-and-locked position, are completed in a single trip.

27 Claims, 15 Drawing Sheets

(56) References Cited

U.S. PATENT DOCUMENTS

| | | | |
|---|---|---|---|
| 4,227,573 | A | 10/1980 | Pearce et al. |
| 4,349,071 | A | 9/1982 | Fish |
| 4,391,326 | A | 7/1983 | Greenlee |
| 4,407,367 | A | 10/1983 | Kydd |
| 4,538,684 | A | 9/1985 | Sheffield |
| 4,735,268 | A | 4/1988 | Harris et al. |
| 4,834,184 | A | 5/1989 | Streich et al. |
| 4,928,762 | A | 5/1990 | Mamke |
| 4,953,617 | A | 9/1990 | Ross et al. |
| 5,178,219 | A | 1/1993 | Streich et al. |
| 5,330,000 | A | 7/1994 | Givens et al. |
| 5,678,635 | A | 10/1997 | Dunlap et al. |
| 5,806,596 | A | 9/1998 | Hardy et al. |
| 6,138,764 | A | 10/2000 | Scarsdale et al. |
| 6,491,108 | B1 | 12/2002 | Slup et al. |
| 6,595,289 | B2 | 7/2003 | Tumlin et al. |
| 6,755,256 | B2 | 6/2004 | Murley et al. |
| 7,424,909 | B2 | 9/2008 | Roberts et al. |
| 7,600,572 | B2 | 10/2009 | Slup et al. |
| 7,762,323 | B2 | 7/2010 | Frazier |
| 8,307,898 | B2 | 11/2012 | Johnson et al. |
| 8,579,024 | B2 | 11/2013 | Mailand et al. |
| 8,770,276 | B1 | 7/2014 | Nish et al. |
| 9,133,671 | B2 | 9/2015 | Kellner |
| 9,359,861 | B2 | 6/2016 | Burgos |
| 9,416,617 | B2 | 8/2016 | Wiese et al. |
| 9,567,834 | B2 | 2/2017 | Moffitt et al. |
| 10,280,706 | B1 | 5/2019 | Sharp, III |
| 10,837,254 | B2 | 11/2020 | Al-Mousa et al. |
| 11,142,976 | B2 | 10/2021 | Al-Mousa et al. |
| 2004/0040707 | A1 | 3/2004 | Dusterhoft et al. |
| 2004/0256113 | A1* | 12/2004 | LoGiudice ..... E21B 41/00 166/381 |
| 2005/0263282 | A1 | 12/2005 | Jeffrey et al. |
| 2006/0213656 | A1 | 9/2006 | Clifton |
| 2007/0181304 | A1 | 8/2007 | Rankin et al. |
| 2008/0314591 | A1 | 12/2008 | Hales et al. |
| 2009/0272544 | A1* | 11/2009 | Giroux ..... E21B 31/12 166/208 |
| 2010/0263856 | A1 | 10/2010 | Lynde et al. |
| 2011/0203794 | A1 | 8/2011 | Moffitt et al. |
| 2012/0125619 | A1* | 5/2012 | Wood ..... E21B 17/042 166/308.1 |
| 2013/0213654 | A1 | 8/2013 | Dewey et al. |
| 2013/0240207 | A1 | 9/2013 | Frazier |
| 2014/0158350 | A1 | 6/2014 | Castillo et al. |
| 2016/0084034 | A1 | 3/2016 | Roane et al. |
| 2016/0281458 | A1 | 9/2016 | Greenlee |
| 2016/0305215 | A1 | 10/2016 | Harris et al. |
| 2016/0340994 | A1 | 11/2016 | Ferguson et al. |
| 2017/0067313 | A1 | 3/2017 | Connell et al. |
| 2017/0089166 | A1 | 3/2017 | Sullivan |
| 2018/0010418 | A1 | 1/2018 | VanLue |
| 2018/0252069 | A1 | 9/2018 | Abdollah et al. |
| 2019/0186232 | A1 | 6/2019 | Ingram |
| 2019/0203551 | A1 | 7/2019 | Davis et al. |
| 2019/0284898 | A1 | 9/2019 | Fagna et al. |
| 2020/0056446 | A1 | 2/2020 | Al-Mousa et al. |
| 2021/0025259 | A1 | 1/2021 | Al-Mousa et al. |
| 2021/0054708 | A1 | 2/2021 | Al-Mousa et al. |

* cited by examiner

LINER SYSTEM WITH INTEGRATED CEMENT RETAINER

TECHNICAL FIELD

This disclosure relates to the production of oil, gas, or other resources from subterranean zones to the surface.

BACKGROUND

Hydrocarbons or other resources in subsurface reservoirs or locations below the Earth's surface can be produced to the surface via wells drilled from the surface to the subsurface locations. After drilling, such wells are completed by installing one or more liners and production tubing to provide a pathway for such resources to flow to the surface. Liners can be cemented into the wellbore by introducing cement into the annular space between the wellbore and the liner or into the annular space between two successive liners. Such cementing can provide support the vertical and radial loads experienced by the liner, isolate different zones within the subsurface location, and provide other benefits.

Some wells undergo cement squeeze operations to repair, solidify, or generally re-cement a portion of a wellbore or liner. A cement squeeze well tool operates to supply cement to an annulus of a wellbore or liner at a location within a wellbore near a perforation, leak, or other unwanted opening in a wall of a wellbore or liner. For example, cement squeeze well tools and methods are utilized when a cemented liner is perforated, faulty, incomplete, or otherwise unsatisfactory and requires additional cement to repair the cemented liner.

SUMMARY

Certain aspects of the subject matter herein can be implemented as a system for performing a cement squeeze operation in a wellbore. The system includes an integrated liner hanger assembly and a running tool. The integrated liner hanger assembly is configured such that, when the integrated liner hanger is positioned within a first liner string positioned within the wellbore, it has an uphole end and a downhole end, and an annulus is partially defined by an outer surface of the integrated liner hanger assembly and an inner surface of the first liner string. The downhole portion of the integrated liner hanger assembly includes a liner hanger that, when actuated, engages slips against the inner surface of the first liner string to prevent axial movement of the integrated liner hanger assembly and to hang a second liner string below the first liner string. The integrated liner hanger assembly also includes a liner top packer assembly configured to isolate, when actuated, a volume of the annulus uphole of the liner top packer assembly from a volume of the annulus downhole of the liner top packer assembly. The integrated liner hanger assembly also includes a cement retainer sub positioned axially uphole of the liner hanger and downhole of the liner top packer assembly. The cement retainer sub includes a plurality of fluid passageways fluidically connecting an central bore of the liner hanger assembly to an annular volume of the annulus downhole of the liner top packer element and uphole of the liner hanger. The cement retainer sub also includes a sliding sleeve configured to translate axially from a first position in which the sleeve prevents a flow of fluid through the fluid passageways to a second position in which the sleeve does not prevent the flow of fluid through the fluid passageways. The running tool includes a plurality of setting dogs and configured to run the integrated liner hanger assembly and the second liner string into the wellbore within the first liner string, actuate the liner hanger, actuate the packer assembly, and axially translate the sliding sleeve from the first position to the second position.

An aspect combinable with any of the other aspects can include the following features. At least some of the plurality of fluid passageways include a one-way valve configured to prevent a flow of fluid from the annulus to the central bore and to allow a flow of fluid from the central bore to the annulus if a fluid pressure within the central bore exceeds an opening pressure of the one-way valve.

An aspect combinable with any of the other aspects can include the following features. The plurality of fluid passageways can be positioned circumferentially around the cement retainer sub.

An aspect combinable with any of the other aspects can include the following features. Actuating of the packer assembly can include axially raising the running tool in an uphold direction and then lowering the running tool such that a first subset of the plurality of setting dogs engage against a landing shoulder of the packer assembly.

An aspect combinable with any of the other aspects can include the following features. Axially translating the sliding sleeve from the first position to the second position can include, after actuating the packer assembly, axially raising the running tool in an uphole direction such that a second subset of the plurality of setting dogs engages against a first landing shoulder of the sliding sleeve.

An aspect combinable with any of the other aspects can include the following features. The sliding sleeve can be further configured to slide axially to a third position in which the sleeve prevents a flow of fluid cement through the fluid passageways and in which the sliding sleeve is locked so as to prevent further axial movement of the sliding sleeve. Sliding of the sliding sleeve from the second position to the third position can include, after axially translating the sliding sleeve from the first position to the second position, axially lowering the running tool in an downhole direction such that a third subset of the plurality of setting dogs engages against a second landing shoulder of the sliding sleeve.

An aspect combinable with any of the other aspects can include the following features. The flow of fluid is a flow from the central bore to the annulus can be a flow of cement.

An aspect combinable with any of the other aspects can include the following features. The flow of cement through the plurality of fluid passageways can be after a cementing job that includes a flow of cement into an annulus between the second liner string and the wellbore.

An aspect combinable with any of the other aspects can include the following features. A volume of the cement flowed through the plurality of fluid passageways can at least partially fill a cement void, unfilled by cement after the cementing job, in the volume of the annulus downhole of the liner top packer assembly.

An aspect combinable with any of the other aspects can include the following features. The steps of (a) running the integrated liner hanger assembly and the second liner string into the wellbore, (b) actuating the liner hanger, (c) actuating the packer assembly, and (d) axially translating the sliding sleeve between the first position to the second position, can be completed in a single trip of the running tool into and out of the wellbore.

Certain aspects of the subject matter herein can be implemented as an integrated liner hanger assembly for performing a cement squeeze operation in a wellbore. The integrated liner hanger assembly is configured to be lowered, by a running tool, within a first liner string cemented into the wellbore and further configured such that, when so lowered, the integrated liner hanger assembly has an uphole end and a downhole end and an annulus is formed by an outer surface of the integrated liner hanger assembly and an inner surface of the first liner string. The integrated liner hanger assembly includes a liner hanger, a liner top packer assembly, and a cement retainer sub. The liner hanger comprises a downhole portion of the integrated liner hanger assembly and is configured to, when actuated by the running tool, engage slips against the inner surface of the first liner string to prevent axial movement of the integrated liner hanger assembly and to hang, within the wellbore below the first liner string, a second liner string. The liner top packer assembly comprises a portion of the integrated liner hanger assembly uphole of the liner hanger and is configured to isolate, when actuated by the running tool, a volume of the annulus uphole of the liner top packer assembly from a volume of the annulus downhole of the liner top packer assembly. The cement retainer sub is positioned axially uphole of the liner hanger and downhole of the liner top packer assembly. The cement retainer sub includes a plurality of fluid passageways fluidically connecting an central bore of the liner hanger assembly to an annular volume of the annulus downhole of the liner top packer element and uphole of the liner hanger. The cement retainer sub further includes a sliding sleeve configured to be translated axially by the running tool from a first position in which the sleeve prevents a flow of fluid through the fluid passageways to a second position in which the sleeve does not prevent the flow of fluid through the fluid passageways.

An aspect combinable with any of the other aspects can include the following features. At least some of the plurality of fluid passageways can include a one-way valve configured to prevent a flow of fluid from the annulus to the central bore and to allow a flow of fluid from the central bore to the annulus if a fluid pressure within the central bore exceeds an opening pressure of the one-way valve An aspect combinable with any of the other aspects can include the following features. The plurality of fluid passageways can be positioned circumferentially around the cement retainer sub.

An aspect combinable with any of the other aspects can include the following features. The integrated liner hanger assembly can be further configured such that actuating of the packer assembly includes axially raising the running tool in an uphold direction and then lowering the running tool such that a first subset of the plurality of setting dogs engage against a landing shoulder of the packer assembly.

An aspect combinable with any of the other aspects can include the following features. The integrated liner hanger assembly can be further configured such that axially translating the sliding sleeve from the first position to the second position can include, after actuating the packer assembly, axially raising the running tool in an uphole direction such that a second subset of the plurality of setting dogs engages against a first landing shoulder of the sliding sleeve.

An aspect combinable with any of the other aspects can include the following features. The sliding sleeve can be further configured to slide axially to a third position in which the sleeve prevents a flow of fluid cement through the fluid passageways and in which the sliding sleeve is locked so as to prevent further axial movement of the sliding sleeve. Sliding of the sliding sleeve from the second position to the third position can include, after axially translating the sliding sleeve from the first position to the second position, axially lowering the running tool in an downhole direction such that a third subset of the plurality of setting dogs engages against a second landing shoulder of the sliding sleeve.

An aspect combinable with any of the other aspects can include the following features. The integrated liner hanger assembly can be further configured such that the flow of fluid from the central bore to the annulus is a flow of cement An aspect combinable with any of the other aspects can include the following features. The integrated liner hanger assembly can be further configured such that the flow of cement through the plurality of fluid passageways is after a cementing job, and the cementing job includes a flow of cement into an annulus between the second liner string and the wellbore.

An aspect combinable with any of the other aspects can include the following features. The integrated liner hanger assembly can be further configured such that a volume of the cement flowed through the plurality of fluid passageways at least partially fills a cement void in the volume of the annulus downhole of the liner top packer assembly, said void unfilled by cement after the cementing job.

An aspect combinable with any of the other aspects can include the following features. The integrated liner hanger assembly can be further configured such that the steps of (a) running the integrated liner hanger assembly and the second liner string into the wellbore, (b) actuating the liner hanger, (c) actuating the packer assembly, and (d) axially translating the sliding sleeve between the first position to the second position, are completed in a single trip of the running tool into and out of the wellbore.

Certain aspects of the subject matter herein can be implemented as a method of performing a cement squeeze operation in a wellbore into which a first liner string has been cemented. The method includes running, by a running tool and into the first liner string, an integrated liner hanger assembly and a second liner string hung therefrom. The integrated liner hanger assembly includes an uphole end and a downhole end and an annulus is formed by an outer surface of the integrated liner hanger assembly and an inner surface of the first liner string. The integrated liner hanger assembly includes a liner hanger, a liner top packer assembly, and a cement retainer sub. The liner hanger comprises a downhole portion of the integrated liner hanger assembly and is configured to, when actuated by the running tool, engage slips against the inner surface of the first liner string to prevent axial movement of the integrated liner hanger assembly and to hang, within the wellbore below the first liner string, a second liner string. The liner top packer assembly comprises a portion of the integrated liner hanger assembly uphole of the liner hanger and is configured to isolate, when actuated by the running tool, a volume of the annulus uphole of the liner top packer assembly from a volume of the annulus downhole of the liner top packer assembly. The cement retainer sub is positioned axially uphole of the liner hanger and downhole of the liner top packer assembly. The cement retainer sub includes a plurality of fluid passageways fluidically connecting an central bore of the liner hanger assembly to an annular volume of the annulus downhole of the liner top packer element and uphole of the liner hanger. The cement retainer sub further includes a sliding sleeve configured to be translated axially by the running tool from a first position in which the sleeve prevents a flow of fluid through the fluid passageways to a second position in which the sleeve does not prevent the flow of fluid through the fluid passageways. The method further includes actuating, by the running tool, the liner hanger by engaging slips of the liner hanger against the inner surface of the first liner string to prevent axial movement of the integrated liner hanger assembly. The method further includes cementing the second liner string in the wellbore by a cementing job comprising flowing cement into an annulus between the second liner string and the wellbore. The method further includes actuating, by the running tool, the liner top packer assembly, thereby isolating a volume of the annulus uphole of the liner top packer assembly from a volume of the annulus downhole of the actuating the liner top packer assembly. The method further includes axially translating, by the running tool, the sliding sleeve from the first position to the second position, and flowing the fluid cement through the fluid passageways and thereby at least partially filling a cement void or leak in the volume of the annulus downhole of the liner top packer assembly, said void or leak unfilled by the cement of the cementing job.

An aspect combinable with any of the other aspects can include the following features. At least some of the plurality of fluid passageways can include a one-way valve configured to prevent a flow of fluid from the annulus to the central bore and to allow a flow of fluid from the central bore to the annulus if a fluid pressure within the central bore exceeds an opening pressure of the one-way valve An aspect combinable with any of the other aspects can include the following features. The plurality of fluid passageways are cam be positioned circumferentially around the cement retainer sub.

An aspect combinable with any of the other aspects can include the following features. The actuating of the packer assembly can include axially raising the running tool in an uphold direction and then lowering the running tool such that a first subset of a plurality of setting dogs of the running tool engage against a landing shoulder of the packer assembly.

An aspect combinable with any of the other aspects can include the following features. Axially translating the sliding sleeve from the first position to the second position can include, after actuating the packer assembly, axially raising the running tool in an uphole direction such that a second subset of the plurality of setting dogs engages against a first landing shoulder of the sliding sleeve.

An aspect combinable with any of the other aspects can include the following features. The sliding sleeve can be further configured to slide axially to a third position in which the sleeve prevents a flow of fluid cement through the fluid passageways and in which the sliding sleeve is locked so as to prevent further axial movement of the sliding sleeve. Sliding of the sliding sleeve from the second position to the third position can include, after axially translating the sliding sleeve from the first position to the second position, axially lowering the running tool in an downhole direction such that a third subset of the plurality of setting dogs engages against a second landing shoulder of the sliding sleeve.

An aspect combinable with any of the other aspects can include the following features. The steps of (a) running the integrated liner hanger assembly and the second liner string into the wellbore, (b) actuating the liner hanger, (c) actuating the packer assembly, and (d) axially translating the sliding sleeve between the first position to the second position, can be completed in a single trip of the running tool into and out of the wellbore.

The details of one or more embodiments are set forth in the accompanying drawings and the description below. Other features, objects, and advantages will be apparent from the description and drawings, and from the claims.

DETAILED DESCRIPTION

The details of one or more implementations of the subject matter of this specification are set forth in this detailed description, the accompanying drawings, and the claims. Other features, aspects, and advantages of the subject matter will become apparent from this detailed description, the claims, and the accompanying drawings.

This disclosure describes an integrated liner hanger assembly, system, and method for performing cement squeeze operations. The assembly, system, and method of some embodiments of the present disclosure can enable the flowing of cement into the annulus downhole of the liner top packer element but above the liner hanger, and further downhole below the liner hanger. The assembly, system, and method of some embodiments of the present disclosure can enable fewer running tool trips (as compared to other apparatus, systems, or methods) in order to position a liner in the well, activate the liner hanger and (after cementing the liner in the well) activate the liner top packer and conduct the remedial cement squeeze operation. In some embodiments, and as described in greater detail below, some or all of these steps can be accomplished in a single trip of the running tool (that is, without removing the running tool from the well until after these steps are accomplished).

Figure 1:
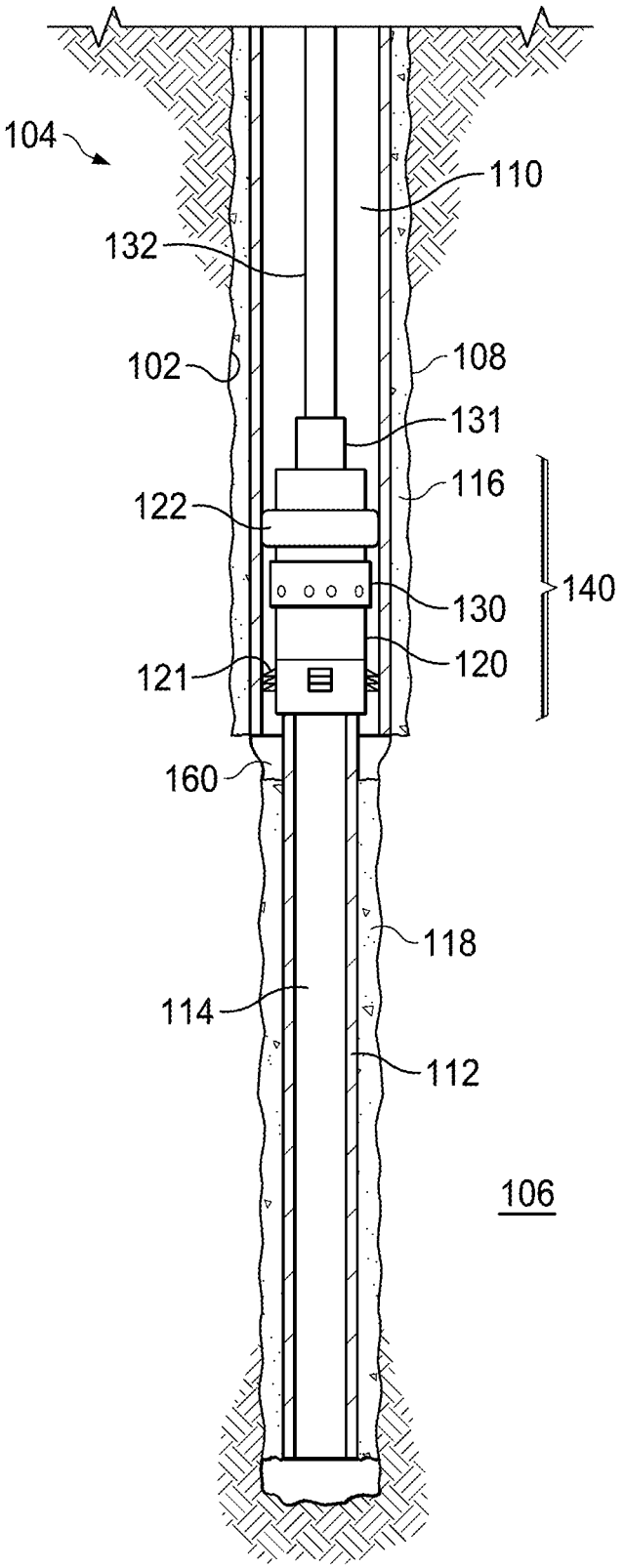
FIG. 1 is a schematic illustration of well system in accordance with an embodiment of the present disclosure.

FIG. 1 is a schematic illustration of well system 100 in accordance with an embodiment of the present disclosure. Referring to FIG. 1, well system 100 that includes a substantially cylindrical wellbore 102 extending into the Earth into one or more subterranean zones of interest; for example, a hydrocarbon producing zone. The example well system 100 shows one subterranean zone 106; however, the example well system 100 can include more than one zone. The well system 100 includes a vertical well, with the wellbore 102 extending substantially vertically from the surface to the subterranean zone 106. The concepts described here, however, are applicable to many different configurations of wells, including vertical, horizontal, slanted, or wells that are otherwise non-horizontal, partially or fully.

After some or all of the wellbore 102 is drilled, a portion of the wellbore 102 extending into to the subterranean zone 106 can be lined with lengths of tubing, called casing or liner. The wellbore 102 can be drilled in stages, the liners can be installed between stages, and cementing operations can be performed to inject cement in stages in the annulus between the liner and inner surface of the wellbore (and/or the annulus between the inner surface of an outer, larger-diameter liner into which the (smaller-diameter) liner has been positioned. In the example well system 100 of FIG. 1, the system 100 includes a first, outer liner 108, defined by lengths of tubing lining an upper portion of the wellbore 102 extending from the surface into the Earth. Outer liner 108 is shown as extending only partially down the wellbore 102.

A first annulus 110 is defined by the outer surface of liner 108 and the inner surface of wellbore 102. The example well system 100 also includes a second, inner liner 112 positioned radially inward from the outer liner 108 and defined by lengths of tubing that line a lower portion of the wellbore 102 that extends further downhole of the wellbore 102 than the portion of the wellbore into which first liner 108 has been positioned. A second annulus 114 is defined in its uphole portion by the outer surface of inner liner 112 and the inner surface of outer liner 108 and in its downhole portion by the inner surface of inner liner 112 and the inner surface of wellbore 102.

In some embodiments of the present disclosure, a well system (such as well system 100) is constructed by lowering a first liner (such as liner 108) into place and then cementing the annulus by injecting a cement slurry downhole through central bore of the liner, such that the cement slurry then travels uphole within the annulus and hardens, shown in FIG. 1 as cement 116 within annulus 110. After installation and cementing of the first liner, the second, smaller-diameter liner (liner 110 in the example shown in FIG. 1) is lowered within the first liner via a work string (not shown in FIG. 1). The upper end of the smaller-diameter liner 110 is connected to (i.e., hung from) liner hanger 120. Inner liner 110 and liner hanger 120 can be run into the wellbore by a running tool 131 at a downhole end of a work string 132. When the inner liner has reached the desired downhole position, liner hanger 120 is activated such that slips on the liner hanger (such as slips 121) engage with the inner surface of the larger-diameter liner, preventing further axial movement of smaller-diameter liner 110. The smaller-diameter liner is then cemented into place using the process as described above, resulting in cement (118) within the respective annulus. After cementing of the smaller-diameter liner into place, a liner-top packer (such as liner-top packer 122 of FIG. 1) is activated so as to isolate annulus 114 from the central bore of liner 108.

While FIG. 1 shows the example well system 100 as including two liners (outer liner 108 and inner liner 110), the well system 100 can include more liners, such as three, four, or more liners of different diameters, sequentially installed and hung from respective liner hanger assemblies and cemented into place as described above.

In the process of cementing liners into place using the procedures described above or other suitable procedures, gaps or voids such as voids 160 of FIG. 1 can sometimes occur or be formed, where the cement does not fully fill the annuli or other volumes defined by the inner or external surfaces of the linings and/or the inner surface of the wellbore, and/or where cement has initially filled the void but the cement has shrunk or because of other causes. Voids or leaks can also result from leaks or other damage to the liners. Such voids or leaks can sometimes result in undesirable loss zones from which drilling fluid or other fluids can escape from the well system into the formation, or in the undesirable flow of fluids from the subterranean zone into the well system.

To address such voids or leaks, a remedial cementing operation called a "cement squeeze" is sometimes performed by pumping cement downhole and into the voids or leaks. As part of such a squeeze operation, an isolation tool known as a cement retainer can be set in the liner to enable the remedial cementing to be applied to a lower interval while providing isolation from the annulus above cement retainer. Such cement retainers are typically positioned above the liner top packer (which in turn is typically installed above the liner hanger), which can limit the effectiveness of a cement squeeze operation to fill voids or leaks below the liner top packer and around and below the liner hanger.

In the embodiment of the present disclosure shown in FIG. 1, a cement retainer sub 130 is positioned axially uphole of liner hanger 120 and downhole of liner top packer assembly 122. As described in further detail below and in reference to the subsequent figures, cement retainer sub 130 is configured to provide pathways for cement from a cement squeeze or other remedial cementing operation to fill cement gaps or other voids or leaks proximate to the liner hanger and below the liner top packer.

In the illustrated embodiment, liner hanger 120, liner top packer assembly 122, and cement retainer sub 130 are components of an integrated liner hanger assembly 140. The integrated liner hanger assembly, system, and method of some embodiments of the present disclosure enables fewer running tool trips (as compared to other apparatus, systems, or methods) in order to position the liner in the well, activate the liner hanger and (after cementing the liner in the well), and activate the liner top packer and conduct the remedial cement squeeze operation. In some embodiments, and as described in greater detail below, some or all of these steps can be accomplished in a single trip of the running tool (that is, without removing the running tool from the well until after the steps are accomplished). Specifically, a single trip in some embodiments includes the steps of (a) placing the running tool, the liner, and liner hanger assembly in the well, (b) axially positioning the liner and the liner hanger assembly at the desired downhole location, (c) activating the slips of the liner hanger, (d) after cementing the liner in the well, activating the liner top packer, (e) opening the fluid passageways of the cement retainer sub to conduct the cement squeeze operation, and (f) closing the fluid passageways of the cement retainer sub after the cement squeeze operation is completed, without removing the running tool from the well during or between steps (a), (b), (c), (d), (e) and (f), and then—after completing steps (a), (b), (c), (d), (e), and (f)—removing the running tool from the well. In some embodiments, additional steps can be done as part of the single trip of the running tool. In some embodiments, only some of steps (a), (b), (c), and (d) are done in the single trip of the running tool.

In some embodiments, the above procedure can be accomplished in a single trip because only a slight axial movement of the running tool is required to slack off weight on the liner hanger to fully engage the hanger slips against the casing and to test the slips. Then the running tool can be disengaged from the hanger by applying higher pressure to collapse the lock ring or pins allowing the running tool to be pulled for few feet to confirm disengagement from the liner hanger, but the internal packoff seals between the running tool and liner hanger ID are still active to perform the cement displacement. After pumping the cement slurry around the liner, the running tool can be pulled partially out of the hanger to expose the liner top packer setting dogs. The running tool can be lowered again to slack off with the settings dogs on top of the tie-back receptacle to compress the liner top packer and create the seal against the casing. If required to perform any cement squeeze operation, the running tool can be pulled up so the opening dogs engage with the loading shoulders of the internal sleeve and open the cementing ports. Once the cement squeeze operation is performed, the running tool can be lowered to close the cementing posts by shifting the internal sleeve down. Finally, the running tool can be pulled fully out of the hanger to surface.

Figure 2:
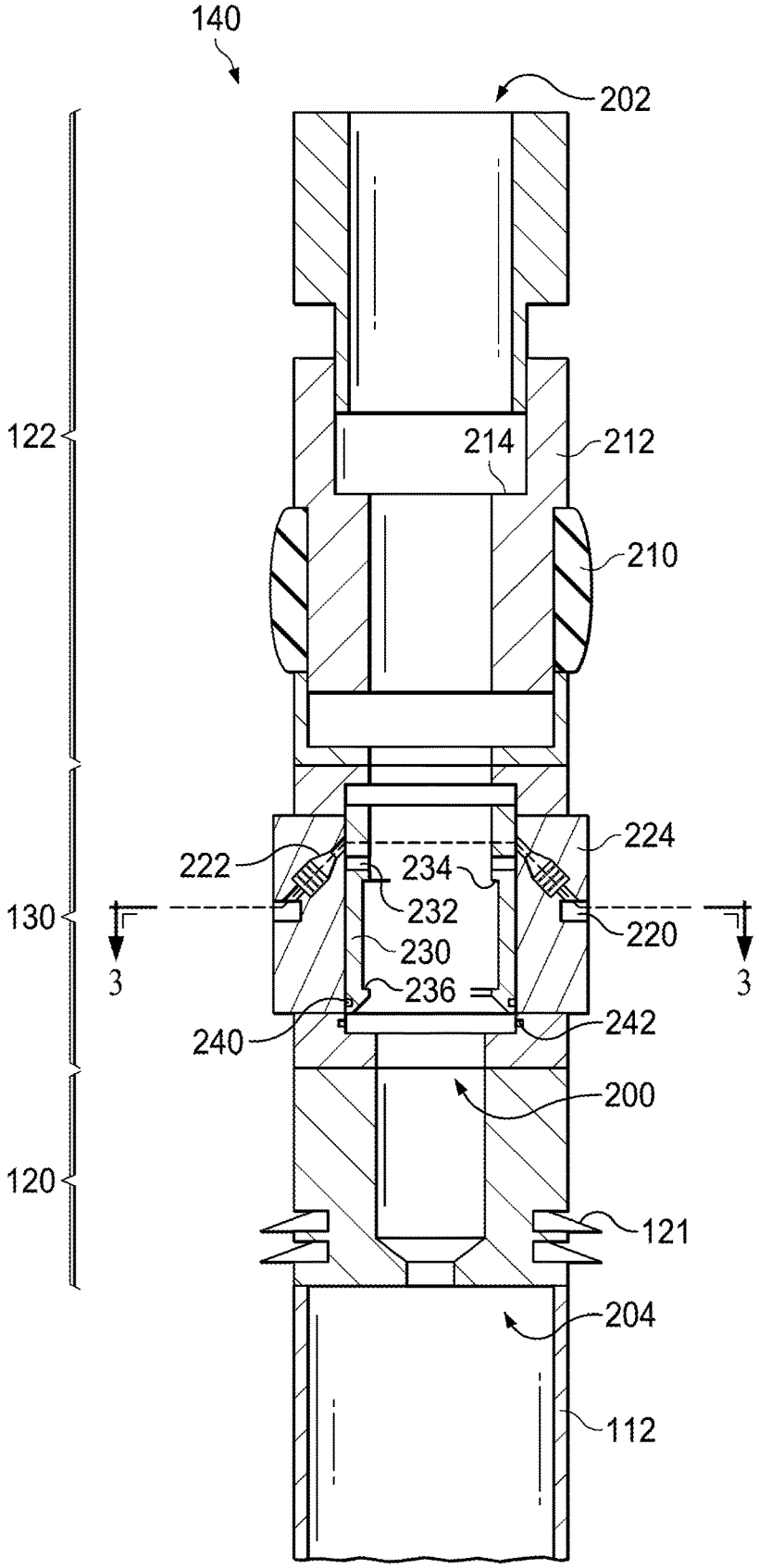
FIG. 2 is a schematic illustration of an integrated liner hanger assembly that can be used for performing a cement squeeze operation, in accordance with an embodiment of the present disclosure.

FIG. 2 is a schematic illustration of an integrated liner hanger assembly 140 of FIG. 1 that can be used for performing a cement squeeze operation, in accordance with an embodiment of the present disclosure. Referring to FIG. 2, liner hanger assembly 140 has a central bore 200 and has, relative to its position when positioned in a wellbore, an uphole end 202 and a downhole end 204. Integrated liner hanger assembly 140 includes a liner hanger 120 comprising a downhole portion of the integrated liner hanger assembly. Liner hanger 120 includes slips 121 that, when actuated, extend outward to engage against an inner surface of a liner string into which integrated liner hanger assembly 140 has been positioned, and thereby prevent, when actuated, axial movement of the integrated liner hanger assembly. A liner string 112 hangs from the downhole end of liner hanger 120. A running tool (shown in FIGS. 4A-4I) engages with integrated liner hanger assembly 140 to lower the liner hanger assembly and the liner string 112 into the wellbore (within the outer liner string that has, in some embodiments, already been cemented into the wellbore).

In the illustrated embodiment, integrated liner hanger assembly 140 further includes liner top packer assembly 122 which includes a packer element 210. In the illustrated embodiment, liner top packer assembly 122 is a mechanically-actuated packer and includes an actuation sleeve 212. Shifting actuation sleeve in a downhole direction (for example, by lowering a running tool with collapsible spring-loaded dogs such that the dogs engage against a landing shoulder 214 of actuation sleeve 212) actuates packer assembly 122 by causing packer element 210 to expand and contact the inner surface of the outer liner string. In this way, liner top packer assembly 122 can, when actuated isolate a volume of an annulus uphole of the liner top packer assembly from a volume of the annulus downhole of the liner top packer assembly. In some embodiments, instead of or in addition to a landing shoulder 214, a running tool can lock into or engage with a locking profile. In some embodiments, packer assembly 122 can be an inflatable packer, a swellable packer, or another suitable packer, instead of or in addition to being mechanically activated.

In the illustrated embodiment, integrated liner hanger assembly 140 further includes cement retainer sub 130 positioned axially uphole (that is, in the direction towards uphole end 202) of the liner hanger 120 and downhole (that is, in the direction towards downhole end 204) of liner top packer assembly 122. Cement retainer sub 130 includes a plurality of fluid passageways 220 through main body 224 fluidically connecting central bore 200 of the liner hanger assembly to the exterior of integrated liner hanger assembly 140. As described in greater detail below, remedial cement from a cement squeeze operation can be flowed from the surface in a downhole direction through central bore 200, to and through fluid passageways 220 (if not blocked by a sliding sleeve as described further below) into an annulus exterior to liner hanger assembly 140. In the illustrated embodiment, at least some of the fluid passageways 220 include a one-way valve 222 configured to prevent a flow of cement or other fluid from the annulus to the central bore and to allow a flow of cement or other fluid from the central bore to the annulus if a fluid pressure within the central bore exceeds an opening pressure of the one-way valve 222. As shown in the cross-sectional view A-A' shown in FIG. 3, in some embodiments, the fluid passageways in some embodiments can be positioned circumferentially around the cement retainer sub 130.

Cement retainer sub 130 further includes sliding sleeve 230 positioned within main body 224, through which are a plurality of sleeve passageways 232. Each sleeve passageway 232 lines up circumferentially with a respective fluid passageway 220. As described in greater detail in reference to FIGS. 4A-4I, sliding sleeve can be axially translated up or down (in an uphole or downhole direction) to different axial positions via, for example, spring-collapsible dogs on the running tool. The running tool dogs can shift the sleeve in an axially uphole direction by, for example, engaging against a first landing shoulder 234, and in an axially downhole direction by, for example, engaging against a second landing shoulder 236 of the sliding sleeve. In some embodiments, instead of, or in addition to, a landing shoulders 234 and 236, a running tool can lock into or engage with a sliding sleeve locking profile.

In a first axial position (the position shown in FIG. 2), sleeve 230 prevents a flow of fluid through the fluid passageways 220 because sleeve passageways 232 are not aligned axially with the fluid passageways 220. In a second position in which sleeve 230 has been translated axially towards uphole end 202, sleeve passageways 232 align axially and circumferentially with fluid passageways 220, such that in this second position sleeve 230 does not prevent fluid flow through fluid passageways 220.

In the illustrated embodiment, sliding sleeve 230 further includes a locking ring 240. When sliding sleeve 230 is translated axially to a third, closed-and-locked position (axially further towards downhole end 204 than the first position shown in FIG. 2), in which locking ring 240 locks into groove 242, preventing further axial movement of sliding sleeve 230.

Figure 3:
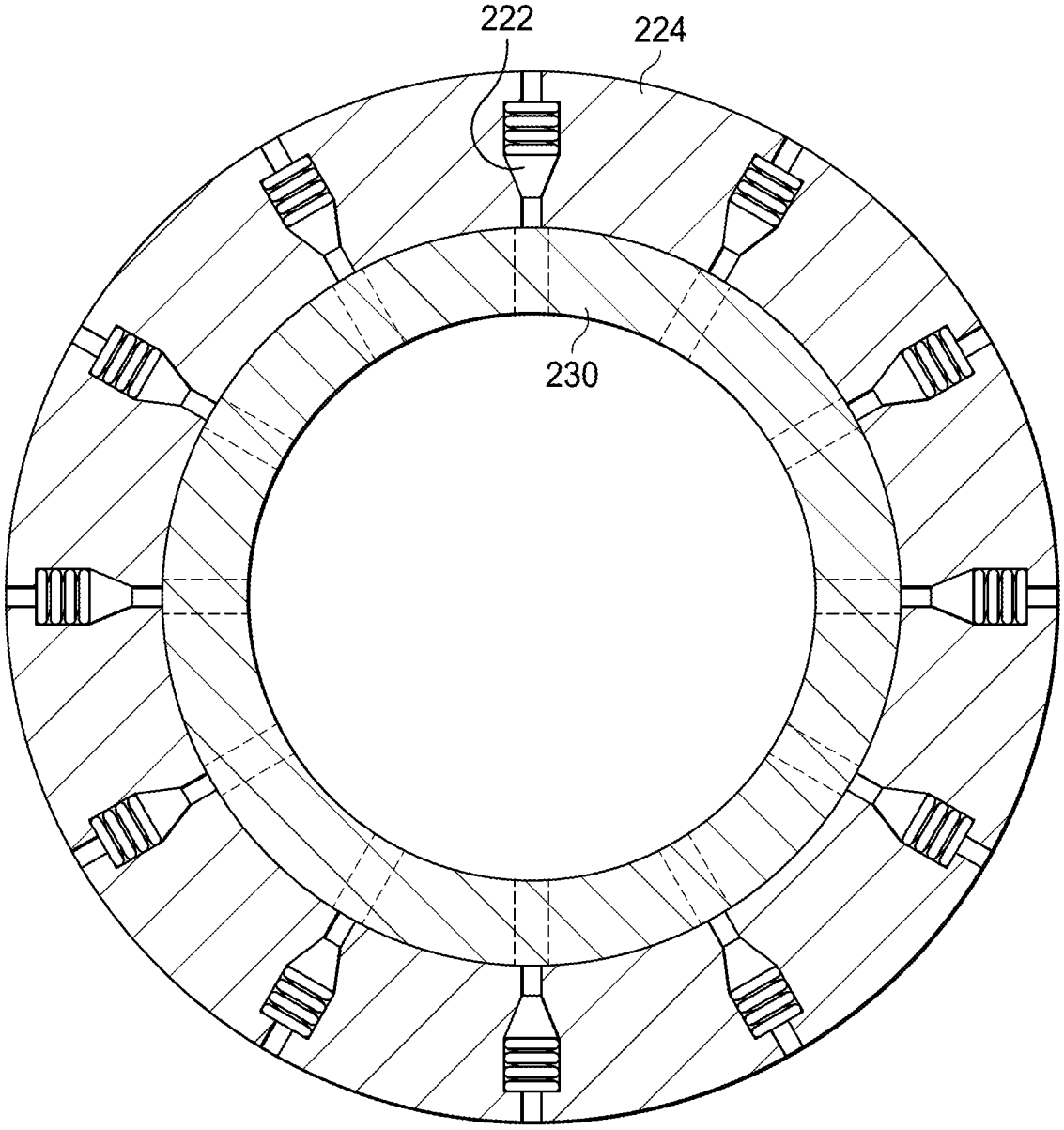
FIG. 3 is a cross-sectional schematic illustration of an integrated liner hanger assembly in accordance with an embodiment of the present disclosure.

FIG. 3 is a schematic illustration of an integrated liner hanger assembly 140, showing cross-section A-A' of FIG. 2 in accordance with an embodiment of the present disclosure. As shown in FIG. 3, the fluid passageways 220 are positioned circumferentially around cement retainer sub 130, so as to more evenly distribute the cement or other fluid flowing from fluid passageways 220 in to the annulus surrounding liner hanger assembly 140.

FIGS. 4A-4I are schematic illustrations of the positioning, configuration, and operation of integrated liner hanger assembly 140 within well system 100 in accordance with a method of the present disclosure.

Figure 4A:
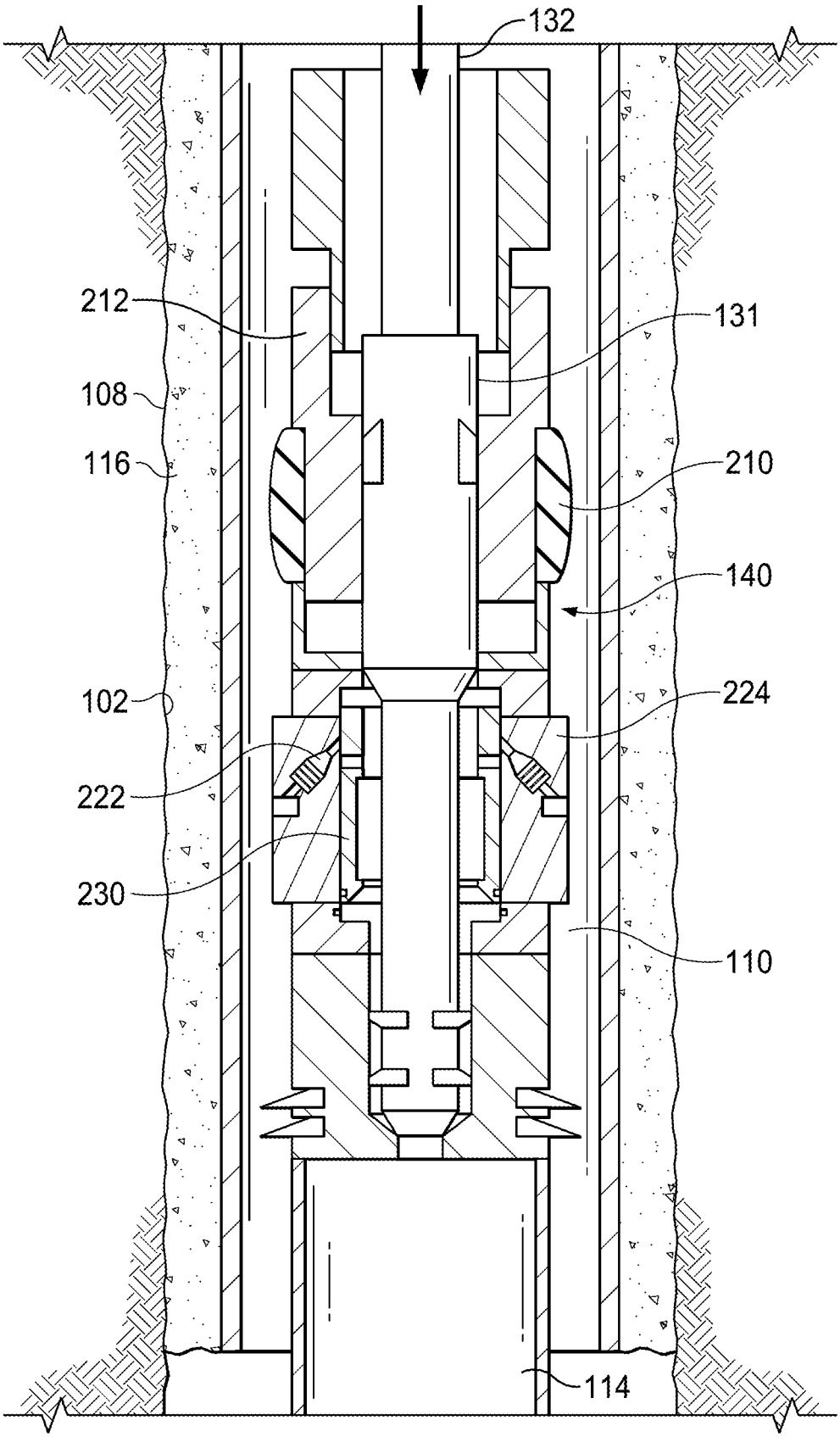
FIGS. 4A-4I are schematic illustrations of the positioning, configuration, and operation of an integrated liner hanger assembly within a well system in accordance with a method of the present disclosure.

Referring to FIG. 4A, and as also described in reference to FIG. 1, integrated liner hanger assembly 140 is lowered by a running tool 131 (attached to a downhole end of work string 132) into a first liner 108 within wellbore 102, within a first liner 108. First annulus 110 is defined by the outer surface of liner 108 and the inner surface of wellbore 102 and is filled with cement 116. Hanging from integrated liner hanger assembly 140 is a second, inner liner 112. A second annulus 114 is defined in its uphole portion by the outer surface of inner liner 112 and the inner surface of outer liner 108 and in its downhole portion by the inner surface of inner liner 112 and the inner surface of wellbore 102.

Figure 4B:
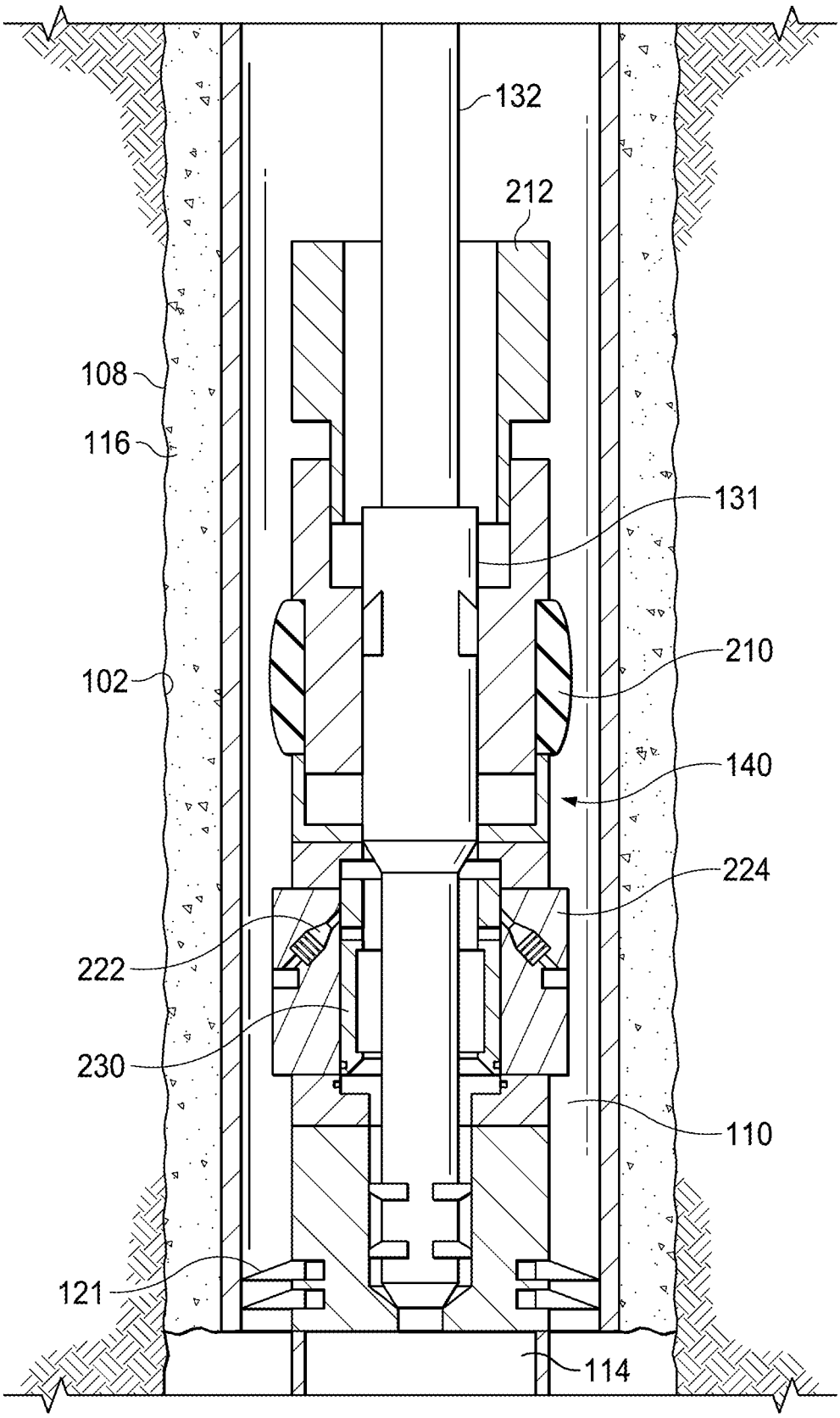
Figure 4C:
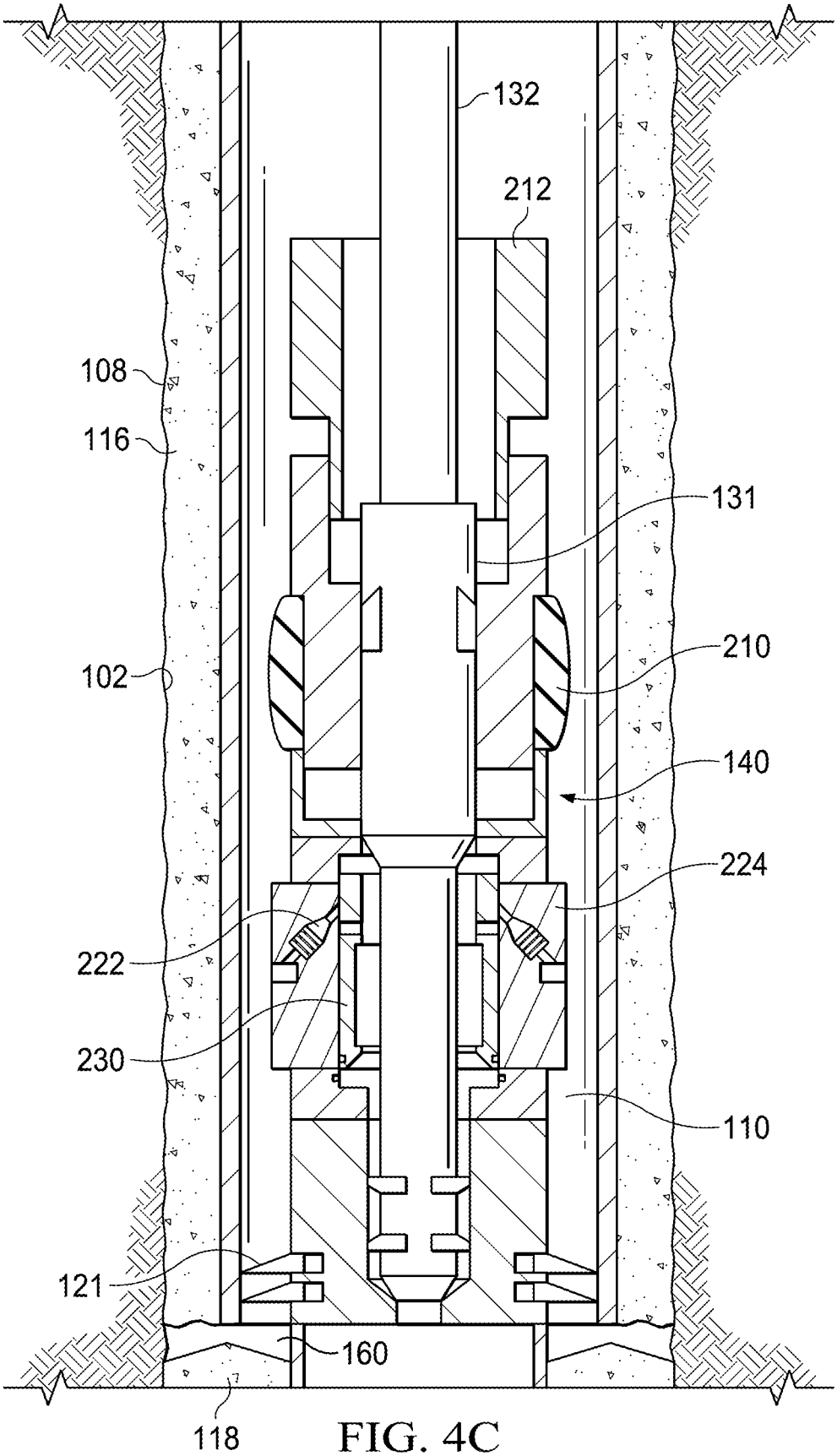

FIG. 4B shows liner hanger assembly 140 as it has reached its desired location and slips 121 are set by running tool 131. In some embodiments, the hanger slips can be positioned against a cone inside the hanger body. During the activation process, hydraulic pressure can be applied internally through ports in the inner diameter of the hanger to push the cone upwards which will push the slips outwards against the casing inner diameter. Then, the running tool and string is lowered to slack off string weight against the slips to fully engage against the casing. Inner liner 112 is then cemented with cement 118, as shown in FIG. 4C. However, because of an incomplete cement job or for other reasons, voids 160 and/or other voids, gaps, or leaks can be present. Because of voids 160 and/or other voids, gaps, or leaks, the operator may determine that a cement squeeze job is desirable.

Figure 4D:
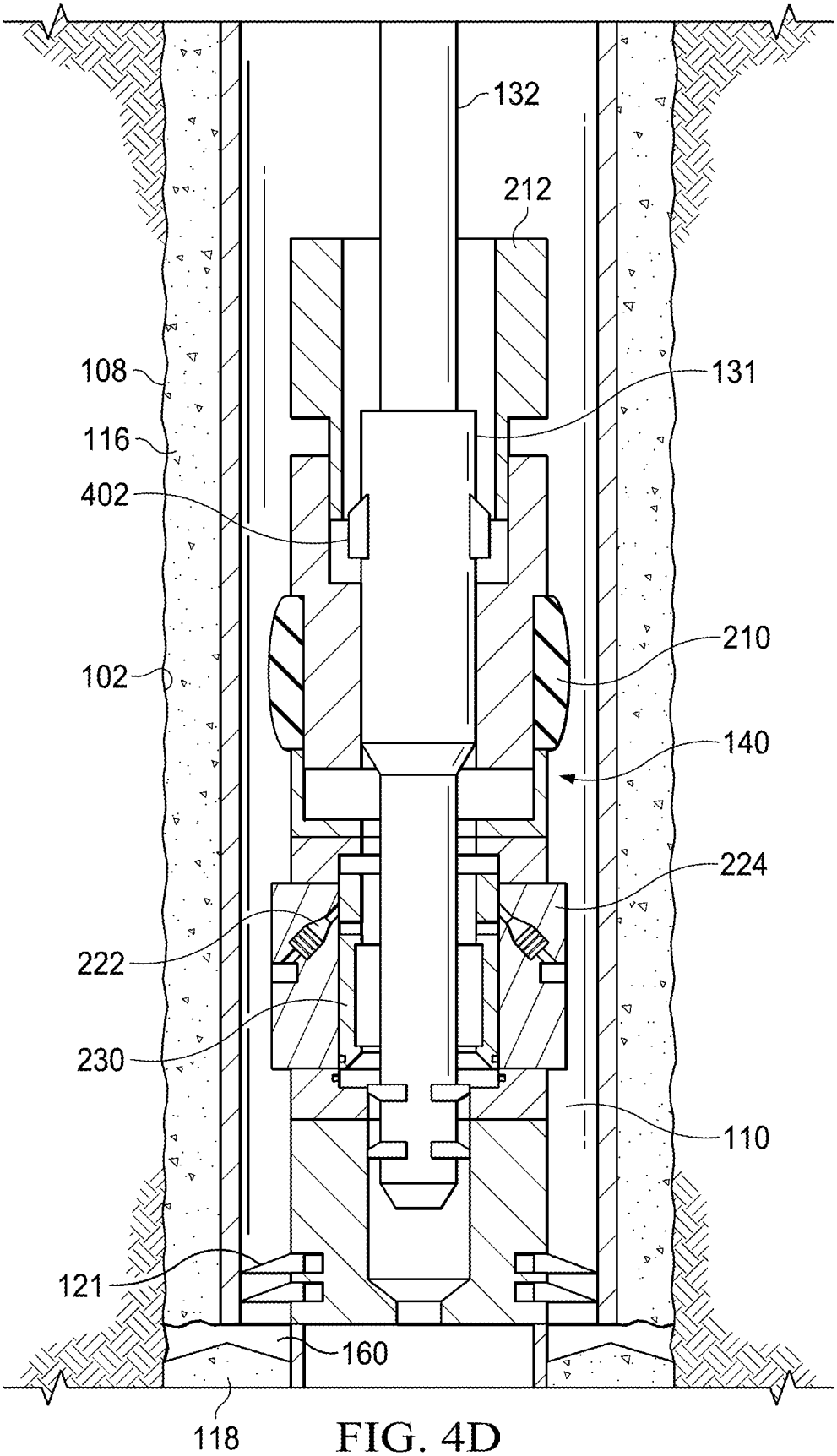
Figure 4E:
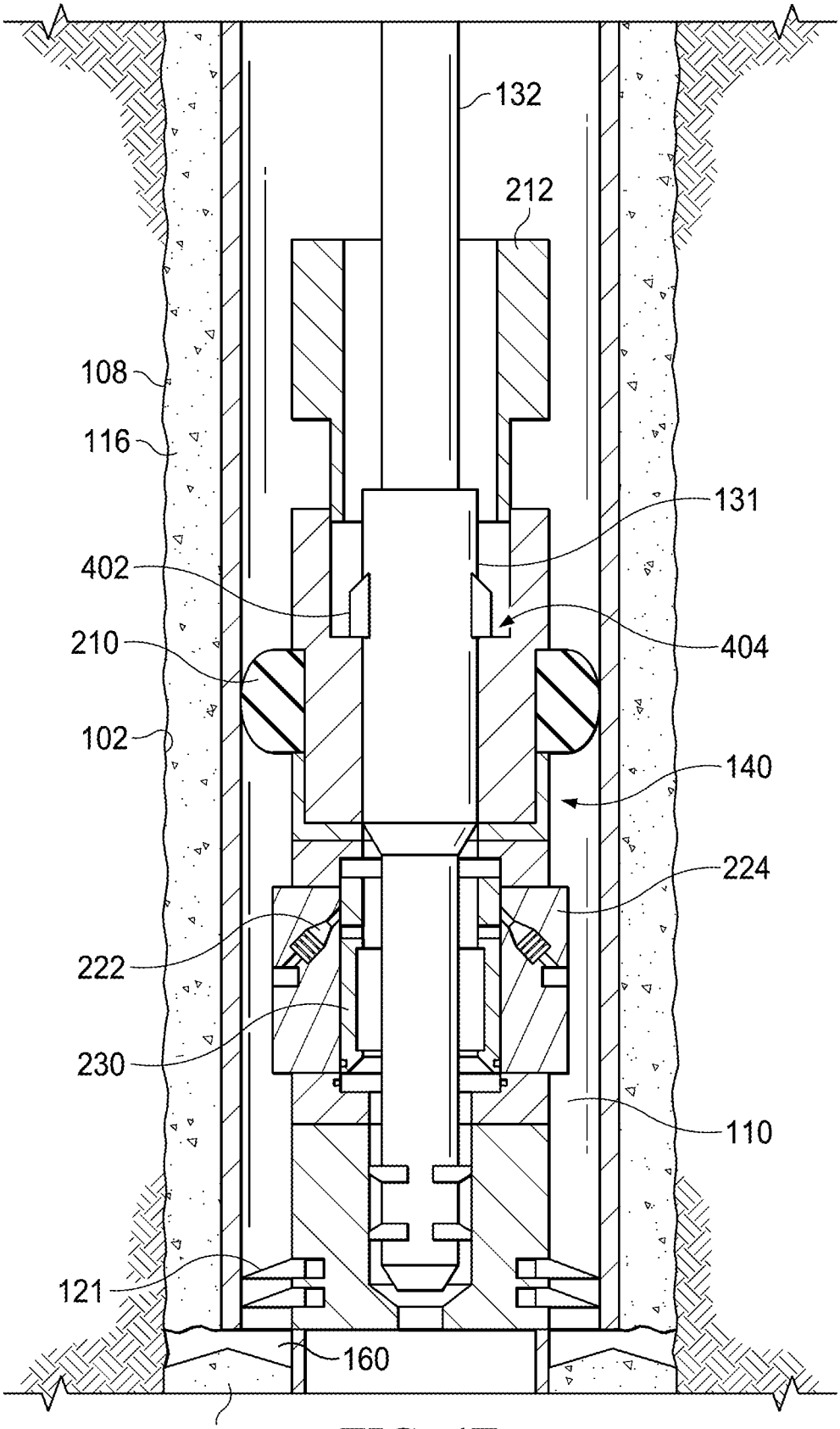

As shown in FIG. 4D, running tool 131 is raised in an uphole direction, exposing the liner top packer settings dogs 402 (which in the illustrated embodiment is a first subset of a plurality of dogs on running tool 131). As shown in FIG. 4E, running tool 131 is lowered to slack off the required weight to set the liner top packer 122 and expand seal elements 210 against the inner surface of liner 108. This will isolate the hydrostatic column of the wellbore fluids above seal element 210 from the annulus 114 behind and below liner assembly 140.

If the operator determines that a cement squeeze job is not desired or required, then after the step shown in FIG. 4E, running tool 131 can be pulled from liner hanger assembly 140 and removed from the well. Liner hanger assembly 140 and running tool 131 can in some embodiments (for example, in the embodiment described in reference to FIGS. 6A and 6B) be configured such that the dogs of running tool 131 do not undesirably engage with any shoulders or other features of liner hanger assembly 140 which could hinder such upward movement of running tool 131 and its removal from liner hanger assembly 140.

Figure 4F:
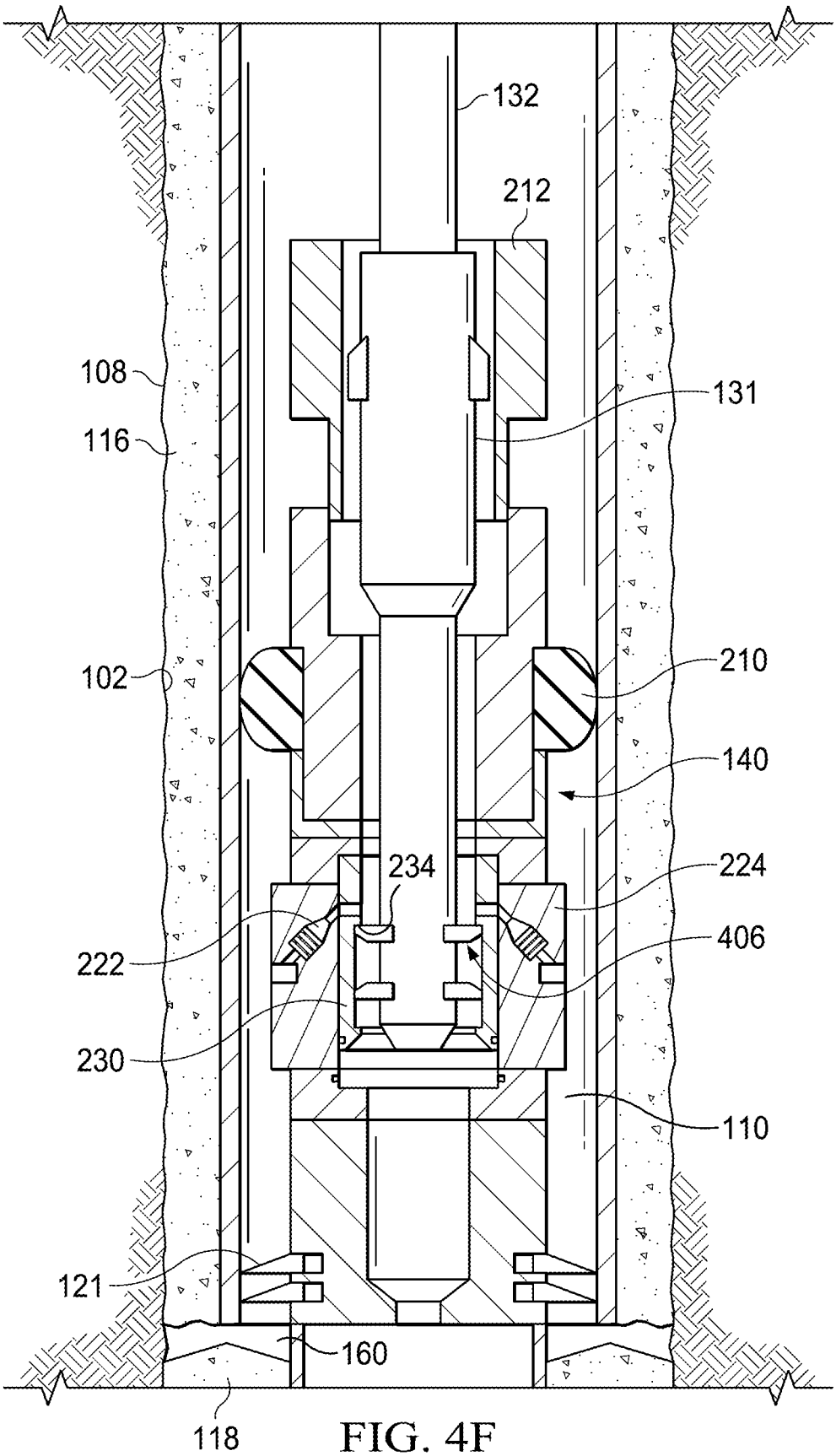

If the operator determines that a cement squeeze job is desired or determined then, as shown in FIG. 4F, running tool 131 can be pulled up further until the sleeve opening dogs 406 (which are a second set of the plurality of dogs on running tool 131) engage the first landing shoulder 234, thereby axially translating sliding sleeve from its first (beginning) position to a second position. In its second position, cement can flow through fluid passageways 220 and sleeve passageways 232. Injection through the cement retainer sub can be established at this point by overcoming a predetermined pumping pressure based on valve size and spring strength of one-way valves 222. The pressure rating of the valves should be adjusted to hold the hydrostatic column above the liner with a safety margin (10-20%). It will also prevent any formation fluid from behind the liner to flow through the cementing path into the wellbore.

Figure 4G:
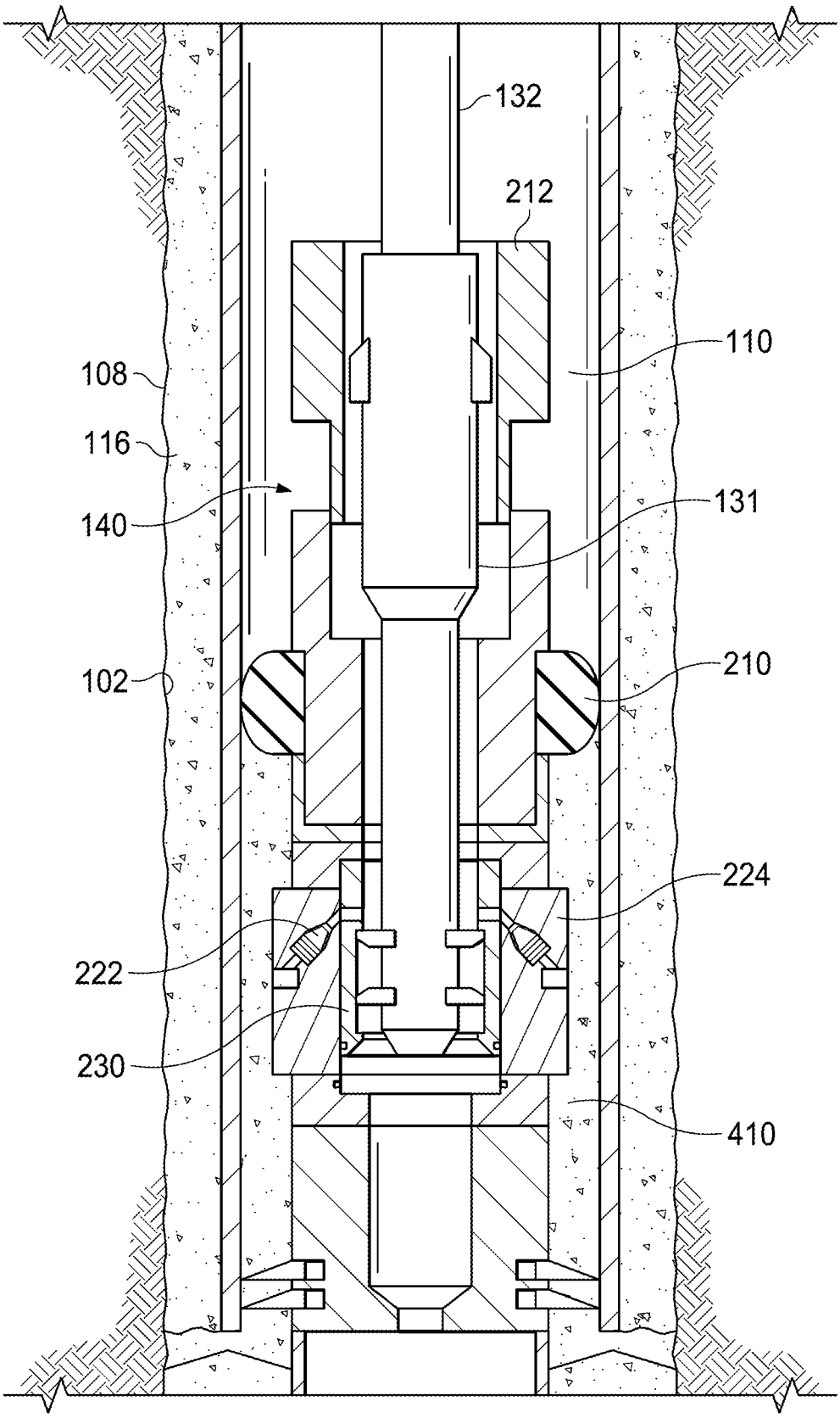

As shown in FIG. 4G, with the surface blowout preventers (BOPS) closed, cement slurry is pumped through the work string and forced to overcome the spring force of one-way valves 222 and fill the annulus behind the liner with the required volume of remedial cement 410 to the expected loss zone; for example, voids 160.

Figure 4H:
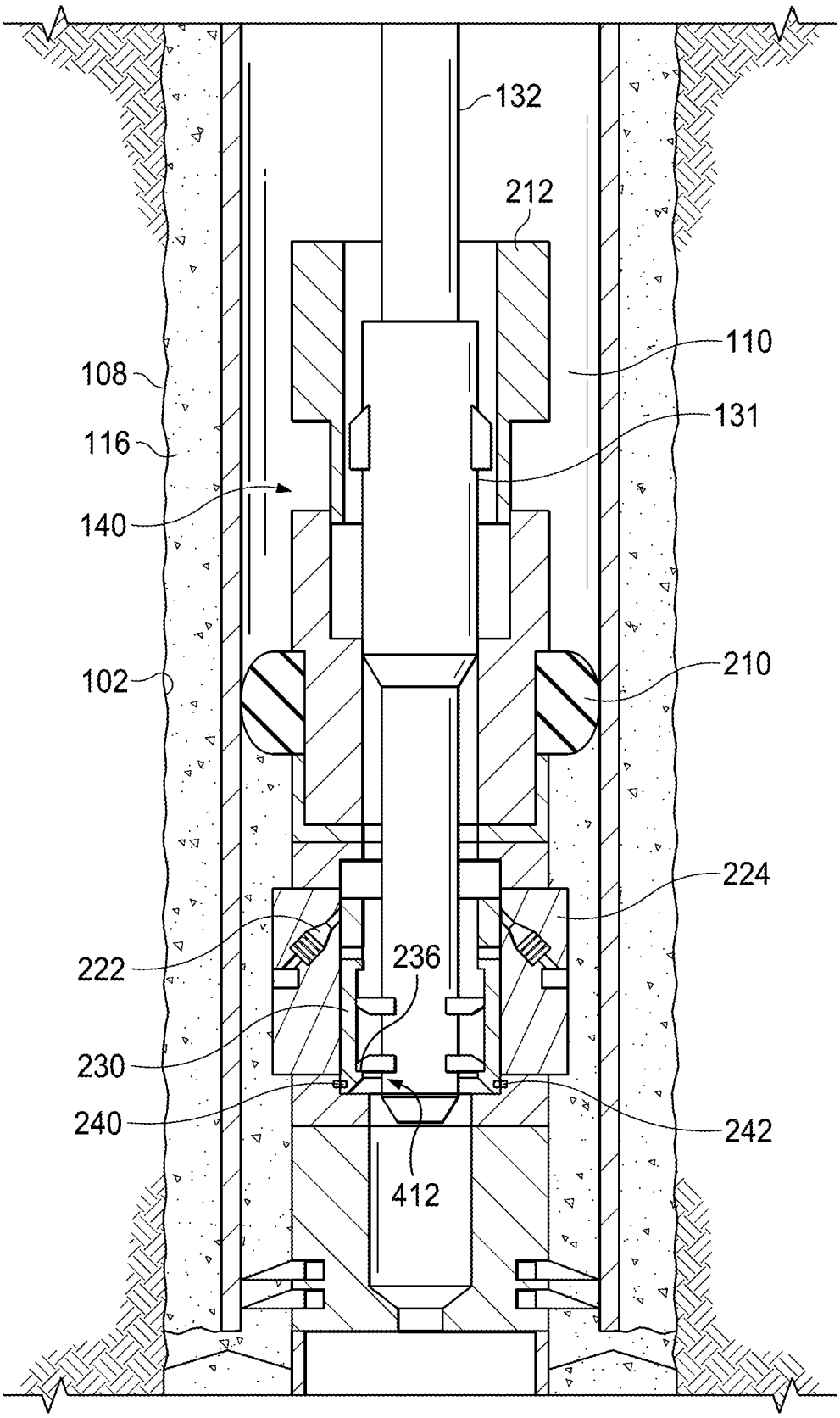
Figure 4I:
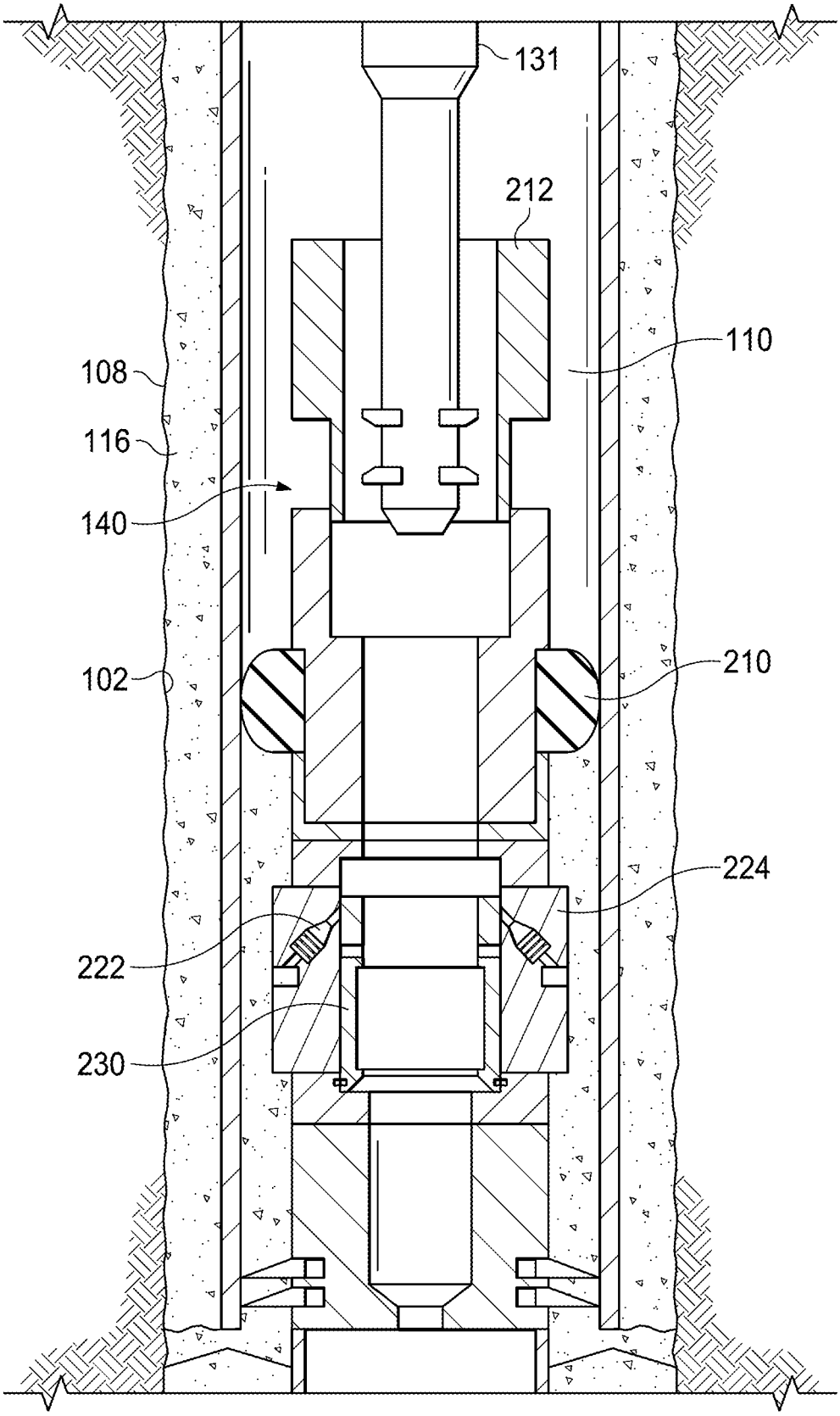

Once cement pumping operation is completed, the one-way valves 222 will close and prevent the hydrostatic column of drilling fluid to push the cement further into the loss zone. As shown in FIG. 4H, liner running tool 131 is lowered down into the integrated liner hanger assembly 140 until the third set of collapsible closing dogs 412 engage the second landing shoulder 236 of the internal sliding sleeve 230 shift it down to the third position, in which lock ring 240 engages with groove 242, locking sliding sleeve in the third position, preventing further axial movement of the sliding sleeve and preventing further fluid flow through fluid passageways 220. As shown in FIG. 4I, liner running tool 131 is then pulled out from liner hanger assembly 140 and removed from the well.

Figure 5A:
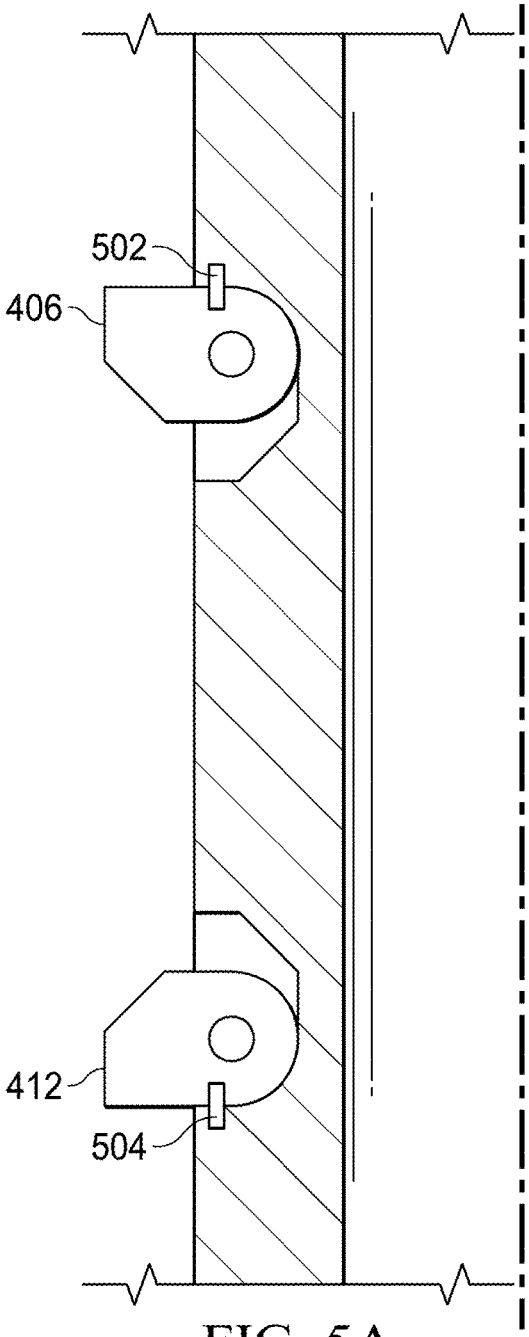
FIGS. 5A and 5B are schematic illustrations of dogs of a running tool of the present invention configured to include shear pins, in accordance with an embodiment of the present disclosure.
Figure 5B:
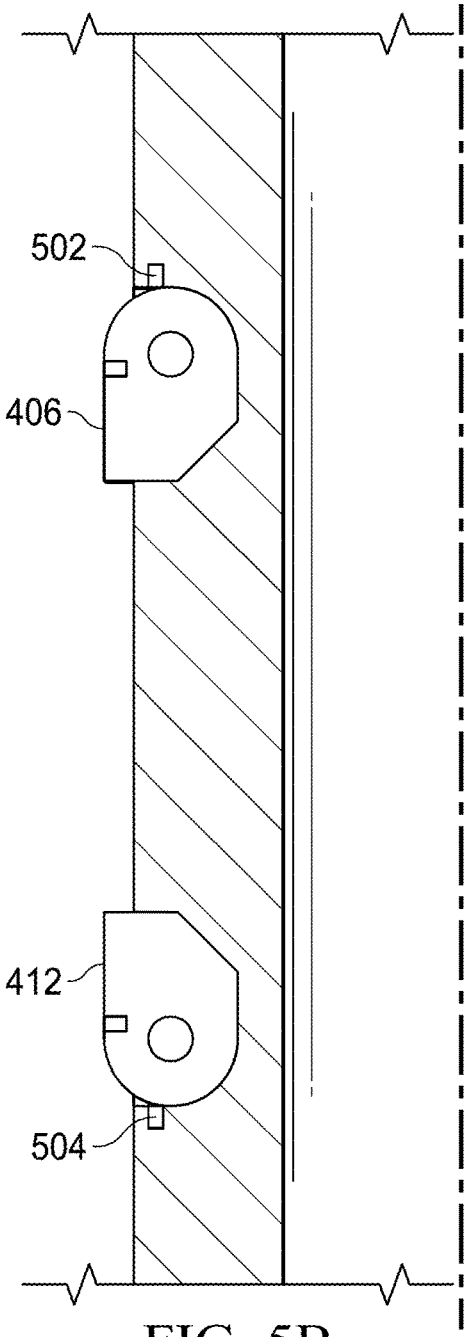

As running tool 131 is pulled upward after locking the sliding sleeve in the third position, if locking dogs 406 or 412 engage against shoulder 234, such engagement could prevent further such upward movement of running tool 131 and thus interfere with removal of running tool 131 from liner hanger assembly 140 and thus from the well. In some embodiments, such undesirable engagement against shoulder 234 can be prevented by including shear pins with dogs 406 and 412 as shown in FIGS. 5A and 5B. FIG. 5A shows locking dogs 406 and 412 held in the initial position by shear pins 502 and 504, respectively. After completion of the step shown in FIG. 4H, shear pins 504 can be sheared by applying additional downward force on running tool 131, and shear pins 502 can be sheared by applying additional upward force on running tool 131. With shear pins 502 and 504 sheared and in a collapsed position as shown in FIG. 5B, running tool 131 can be freely removed from liner hanger assembly 140 as shown in FIG. 4I, without any undesirable engagement of dogs 406 and 412 against shoulder 234 or other components or features of liner hanger assembly 140. In some embodiments, running tool 131 includes internal springs (not shown) engaged with and biasing dogs 406 and 412 towards the collapsed position such that, after shearing of shear pins 502 and 504, dogs 406 and 412 are biased towards and held in the collapsed position by the springs.

Figure 6A:
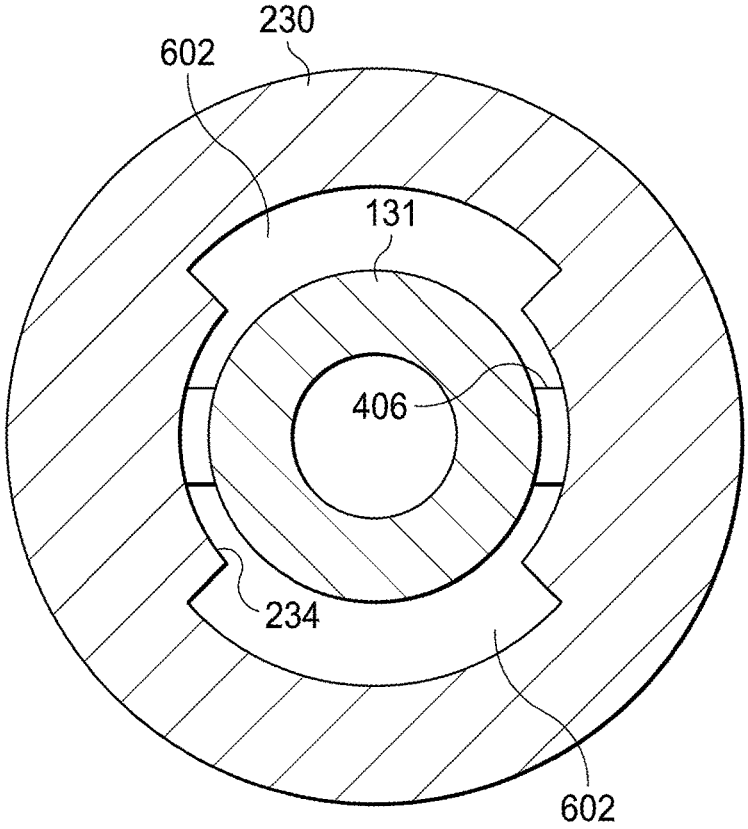
FIGS. 6A and 6B are schematic illustrations of a sliding sleeve of an integrated liner hanger assembly includes gaps in the locking shoulder so as to allow a running tool to be raised and removed from the liner hanger assembly without engaging with the locking shoulder.
Figure 6B:
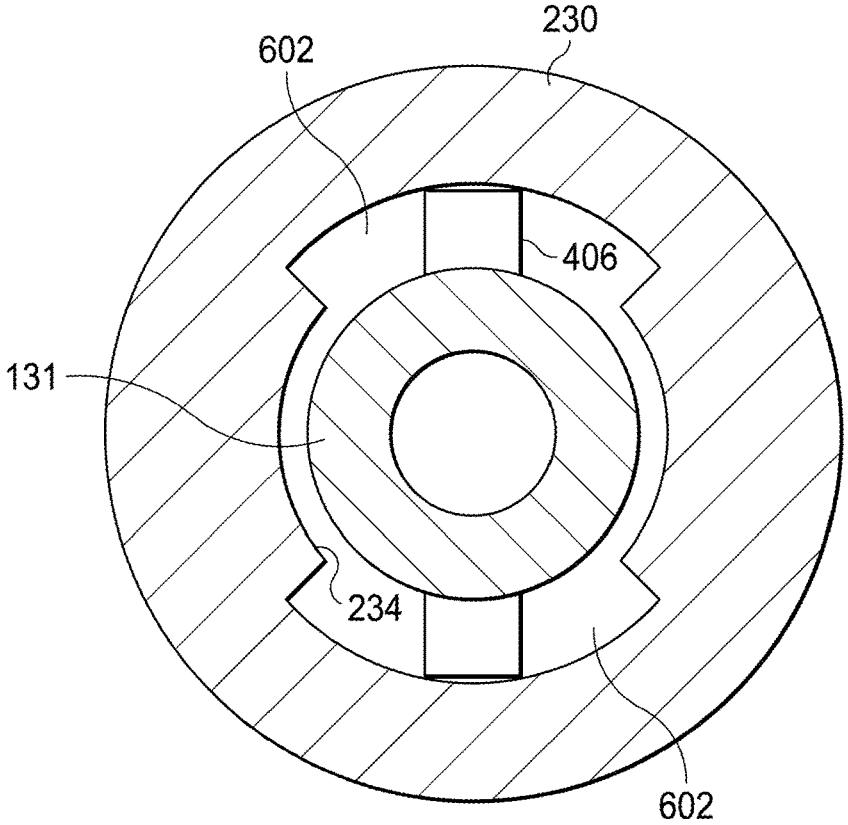

FIGS. 6A and 6B illustrate an alternative (or additional) means for ensuring that running tool 131 can be freely removed from liner hanger assembly 140 (for example, if after the step shown in FIG. 4E, the operator determines that no cement squeeze job is desired or required, and/or, if after the step shown in FIG. 4E the operator determines that a squeeze job is desired or required). FIGS. 6A and 6B show a cross-sectional view of sliding sleeve 230, looking in a downhole direction. As shown in FIGS. 6A and 6B, liner hanger assembly 140 can be manufactured and configured such that locking shoulder 234 includes gaps or openings 602 such that shoulder 234 does not extend circumferentially about the entire internal surface of sliding sleeve 230. In the embodiment shown in FIGS. 6A and 6B, gaps 602 each extend about a quarter around the inner circumference of the sleeve and are diametrically opposed. During the deployment of the liner hanger assembly 140, as shown in FIG. 6A, running tool 131 can be in positioned rotationally such that locking dogs 406 are aligned against the shoulders 234. If the operator determines that a cement squeeze job is not desired or required (for example, after the step shown in FIG. 4E), then running tool 131 can be rotated (for example, a quarter turn) such that dogs 406 do not engage with shoulder 234 and the running tool can be removed from liner hanger assembly 140 and from the well. If after the step shown in FIG. 4E the operator determines that a cement squeeze job is desired or required, then, after the operator performs the steps shown in FIGS. 4F through 4I, running tool 131 then can be rotated (for example, a quarter turn) such that dogs 406 do not engage with shoulder 234 and the running tool can be removed from liner hanger assembly 140 and from the well.

Figure 7:
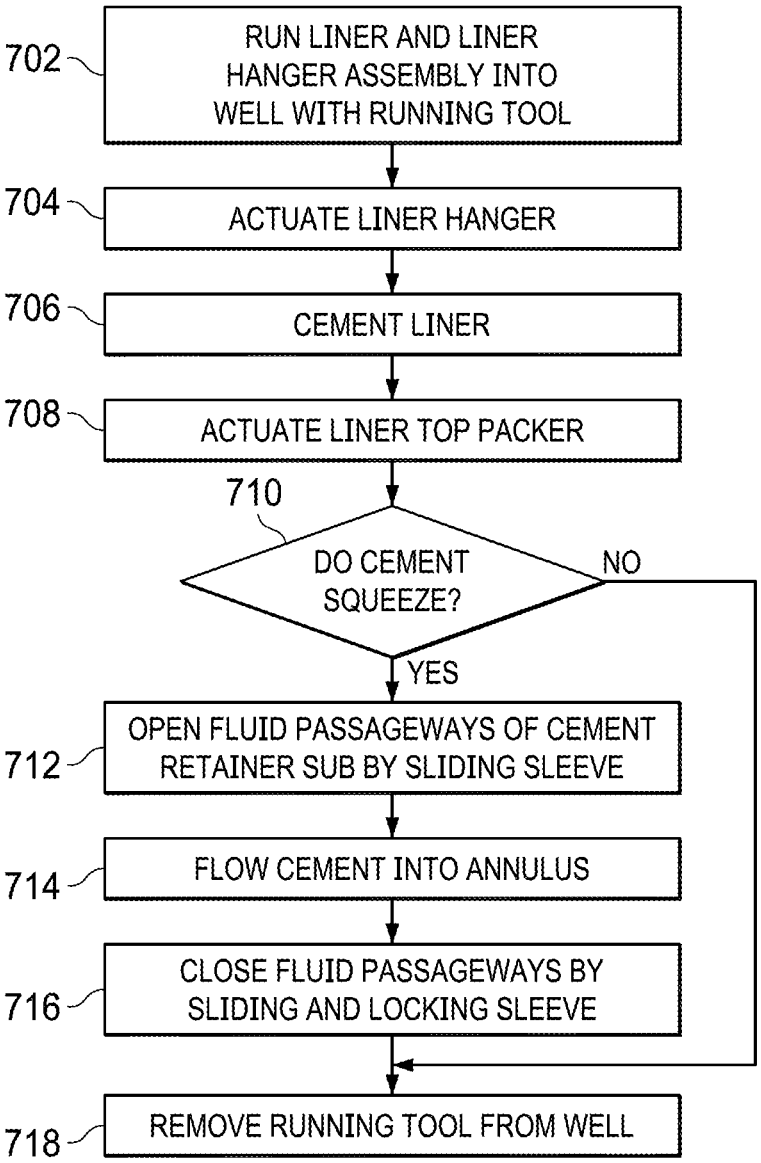
FIG. 7 is a process flow diagram of a method of performing a cement squeeze operation in a wellbore into which a first liner string has been cemented, using an integrated tubing hanger assembly in accordance with an embodiment of the present disclosure.

FIG. 7 is a process flow diagram of a method 700 of performing a cement squeeze operation in a wellbore into which a first liner string has been cemented, using an integrated tubing hanger assembly in accordance with an embodiment of the present disclosure. The method begins at step 702 in which an integrated liner hanger assembly with a second liner string is run by a running tool into the first liner string. In some embodiments, the integrated liner hanger assembly as substantially as described in reference to FIGS. 1 and 2. Accordingly, the integrated liner hanger assembly, when positioned in the wellbore, has an uphole end and a downhole end and an annulus is formed by an outer surface of the integrated liner hanger assembly and an inner surface of the first liner string. The integrated liner hanger assembly includes (a) a liner hanger comprising a downhole portion of the integrated liner hanger assembly, (b) a liner top packer assembly comprising a portion of the integrated liner hanger assembly uphole of the liner hanger, and (c) a cement retainer sub positioned axially uphole of the liner hanger and downhole of the liner top packer assembly. The cement retainer sub in turn includes a plurality of fluid passageways fluidically connecting an central bore of the liner hanger assembly to an annular volume of the annulus downhole of the liner top packer assembly and uphole of the liner hanger, and a sliding sleeve configured to translate axially from a first position in which the sleeve prevents a flow of fluid cement through the fluid passageways to a second position in which the sleeve does not prevent the flow of fluid cement through the fluid passageways. In some embodiments, the integrated liner hanger assembly includes other components in addition to, or instead of, the above components.

Proceeding to step 704, the liner hanger is actuated by the running tool, thereby engaging slips of the liner hanger against the inner surface of the first liner string and preventing further axial movement of the integrated liner hanger assembly. Proceeding to step 706, the second liner string is cemented in the wellbore by conducting a cementing job comprising flowing cement into an annulus between the second liner string and the wellbore. Proceeding to step 708, the liner top packer assembly is actuated by the running tool, thereby isolating a volume of the annulus uphole of the liner top packer assembly from a volume of the annulus downhole of the actuating the liner top packer assembly.

Proceeding to step 710, the operator determines whether a cement squeeze job is desired or required. If at step 710 the operator determines that a cement squeeze job is desired or required, then the method proceeds to step 712 in which the sliding sleeve is axially translated by the running tool from the first position to the second position. Proceeding to step 714, fluid cement is flowed through the fluid passageways, at least partially filling a cement void or leak in the volume of the annulus downhole of the liner top packer assembly, said void or leak having been unfilled by the cement of the cementing job.

Proceeding to step 716, the sliding sleeve is axially translated by the running tool to a third, closed-and-locked position in which the sleeve prevents a flow of fluid cement through the fluid passageways and in which the sliding sleeve is locked so as to prevent further axial movement of the sliding sleeve. At step 718, the running tool is removed from the well. In some embodiments, as described above, steps 702 through 716 are accomplished in a single trip of the running tool (that is, without removing the tool from the wellbore during (or between) any of steps 702, 704, 706, 708, 710, 712, 714, and 716). In some embodiments, method 700 can be accomplished in two or more trips of the running tool.

Returning to step 710, if the operator determines that no cement squeeze job is required, then the method proceeds step 718 in which the running tool is removed from the well and steps 712 through 716 are not performed.

The term "uphole" as used herein means in the direction along the production tubing or the wellbore from its distal end towards the surface, and "downhole" as used herein means the direction along the production tubing or the wellbore from the surface towards its distal end. A downhole location means a location along the production tubing or wellbore downhole of the surface.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A system for performing a cement squeeze operation in a wellbore, the system comprising:

(a) an integrated liner hanger assembly configured such that, when the integrated liner hanger is positioned within a first liner string positioned within the wellbore:

the integrated liner hanger assembly has an uphole end and a downhole end; and an annulus is partially defined by an outer surface of the integrated liner hanger assembly and an inner surface of the first liner string;

and wherein the integrated liner hanger assembly comprises:

a liner hanger comprising a downhole portion of the integrated liner hanger assembly and configured to, when actuated, engage slips against the inner surface of the first liner string to prevent axial movement of the integrated liner hanger assembly and to hang, within the wellbore below the first liner string, a second liner string;

a liner top packer assembly comprising a portion of the integrated liner hanger assembly uphole of the liner hanger and configured to isolate, when actuated, a volume of the annulus uphole of the liner top packer assembly from a volume of the annulus downhole of the liner top packer assembly;

a cement retainer sub positioned axially uphole of the liner hanger and downhole of the liner top packer assembly and comprising:

a plurality of fluid passageways fluidically connecting an central bore of the liner hanger assembly to an annular volume of the annulus downhole of the liner top packer element and uphole of the liner hanger; and a sliding sleeve configured to translate axially from a first position in which the sleeve prevents a flow of fluid through the fluid passageways to a second position in which the sleeve does not prevent the flow of fluid through the fluid passageways; and (b) a running tool comprising a plurality of setting dogs and configured to:

run the integrated liner hanger assembly and the second liner string into the wellbore within the first liner string;

actuate the liner hanger;

actuate the packer assembly; and axially translate the sliding sleeve from the first position to the second position.

2. The system of claim 1, wherein at least some of the plurality of fluid passageways comprise a one-way valve configured to prevent a flow of fluid from the annulus to the central bore and to allow a flow of fluid from the central bore to the annulus if a fluid pressure within the central bore exceeds an opening pressure of the one-way valve.

3. The system of claim 1, wherein the plurality of fluid passageways are positioned circumferentially around the cement retainer sub.

4. The system of claim 1, wherein the actuating of the packer assembly comprises axially raising the running tool in an uphold direction and then lowering the running tool such that a first subset of the plurality of setting dogs engage against a landing shoulder of the packer assembly.

5. The system of claim 4, wherein axially translating the sliding sleeve from the first position to the second position comprises, after actuating the packer assembly, axially raising the running tool in an uphole direction such that a second subset of the plurality of setting dogs engages against a first landing shoulder of the sliding sleeve.

6. The system of claim 5, wherein the sliding sleeve is further configured to be translated axially to a third position in which the sleeve prevents a flow of fluid cement through the fluid passageways and in which the sliding sleeve is locked so as to prevent further axial movement of the sliding sleeve, and wherein a sliding of the sliding sleeve from the second position to the third position comprises, after axially translating the sliding sleeve from the first position to the second position, axially lowering the running tool in an downhole direction such that a third subset of the plurality of setting dogs engages against a second landing shoulder of the sliding sleeve.

7. The system of claim 1, wherein the flow of fluid is a flow from the central bore to the annulus comprises a flow of cement.

8. The system of claim 7, wherein the flow of cement through the plurality of fluid passageways is after a cementing job comprising a flow of cement into an annulus between the second liner string and the wellbore.

9. The system of claim 7, wherein a volume of the cement flowed through the plurality of fluid passageways at least partially fills a cement void in the volume of the annulus downhole of the liner top packer assembly, said void unfilled by cement after the cementing job.

10. The system of claim 6, wherein the steps of (a) running the integrated liner hanger assembly and the second liner string into the wellbore, (b) actuating the liner hanger, (c) actuating the packer assembly, (d) axially translating the sliding sleeve between the first position to the second position, and (e) axially translating the sliding sleeve between the second position to the third position, are completed in a single trip of the running tool into and out of the wellbore.

11. A integrated liner hanger assembly for performing a cement squeeze operation in a wellbore, the integrated liner hanger assembly configured to be lowered, by a running tool, within a first liner string cemented into the wellbore and further configured such that, when so lowered, the integrated liner hanger assembly has an uphole end and a downhole end and an annulus is formed by an outer surface of the integrated liner hanger assembly and an inner surface of the first liner string, the integrated liner hanger assembly comprising:

a liner hanger comprising a downhole portion of the integrated liner hanger assembly and configured to, when actuated by the running tool, engage slips against the inner surface of the first liner string to prevent axial movement of the integrated liner hanger assembly and to hang, within the wellbore below the first liner string, a second liner string;

a liner top packer assembly comprising a portion of the integrated liner hanger assembly uphole of the liner hanger and configured to isolate, when actuated by the running tool within the wellbore, a volume of the annulus uphole of the liner top packer assembly from a volume of the annulus downhole of the liner top packer assembly;

a cement retainer sub positioned axially uphole of the liner hanger and downhole of the liner top packer assembly and comprising:

a plurality of fluid passageways fluidically connecting an central bore of the liner hanger assembly to an annular volume of the annulus downhole of the liner top packer element and uphole of the liner hanger; and a sliding sleeve configured to be translated axially by the running tool from a first position in which the sleeve prevents a flow of fluid through the fluid passageways to a second position in which the sleeve does not prevent the flow of fluid through the fluid passageways.

12. The integrated liner hanger assembly of claim 11, wherein at least some of the plurality of fluid passageways comprise a one-way valve configured to prevent a flow of fluid from the annulus to the central bore and to allow a flow of fluid from the central bore to the annulus if a fluid pressure within the central bore exceeds an opening pressure of the one-way valve.

13. The integrated liner hanger assembly of claim 11, wherein the plurality of fluid passageways are positioned circumferentially around the cement retainer sub.

14. The integrated liner hanger assembly of claim 11, wherein the integrated liner hanger assembly is further configured such that the actuating of the packer assembly comprises axially raising the running tool in an uphold direction and then lowering the running tool such that a first subset of the plurality of setting dogs engage against a landing shoulder of the packer assembly.

15. The integrated liner hanger assembly of claim 14, wherein the integrated liner hanger assembly is further configured such that axially translating the sliding sleeve from the first position to the second position comprises, after actuating the packer assembly, axially raising the running tool in an uphole direction such that a second subset of the plurality of setting dogs engages against a first landing shoulder of the sliding sleeve.

16. The integrated liner hanger assembly of claim 15, wherein the sliding sleeve is further configured to be translated axially to a third position in which the sleeve prevents a flow of fluid cement through the fluid passageways and in which the sliding sleeve is locked so as to prevent further axial movement of the sliding sleeve, and wherein translating axially the sliding sleeve from the second position to the third position comprises, after axially translating the sliding sleeve from the first position to the second position, axially lowering the running tool in an downhole direction such that a third subset of the plurality of setting dogs engages against a second landing shoulder of the sliding sleeve.

17. The integrated liner hanger assembly of claim 11, wherein the integrated liner hanger assembly is further configured such that the flow of fluid is a flow from the central bore to the annulus comprises a flow of cement.

18. The integrated liner hanger assembly of claim 17, wherein the integrated liner hanger assembly is further configured such that the flow of cement through the plurality of fluid passageways is after a cementing job comprising a flow of cement into an annulus between the second liner string and the wellbore.

19. The integrated liner hanger assembly of claim 17, wherein the integrated liner hanger assembly is further configured such that a volume of the cement flowed through the plurality of fluid passageways at least partially fills a cement void in the volume of the annulus downhole of the liner top packer assembly, said void unfilled by cement after the cementing job.

20. The integrated liner hanger assembly of claim 16, wherein the integrated liner hanger assembly is further configured such that the steps of (a) running the integrated liner hanger assembly and the second liner string into the wellbore, (b) actuating the liner hanger, (c) actuating the packer assembly, and (d) axially translating the sliding sleeve between the first position to the second position, and (e) axially translating the sliding sleeve from the second position to the third position, are completed in a single trip of the running tool into and out of the wellbore.

21. A method of performing a cement squeeze operation in a wellbore into which a first liner string has been cemented, the method comprising:

running, by a running tool and into the first liner string, an integrated liner hanger assembly and a second liner string hung therefrom, wherein the integrated liner hanger assembly comprises an uphole end and a downhole end and an annulus is formed by an outer surface of the integrated liner hanger assembly and an inner surface of the first liner string, and wherein the integrated liner hanger assembly comprises:

a liner hanger comprising a downhole portion of the integrated liner hanger assembly:

a liner top packer assembly comprising a portion of the integrated liner hanger assembly uphole of the liner hanger;

a cement retainer sub positioned axially uphole of the liner hanger and downhole of the liner top packer assembly, the cement retainer sub comprising:

a plurality of fluid passageways fluidically connecting an central bore of the liner hanger assembly to an annular volume of the annulus downhole of the liner top packer assembly and uphole of the liner hanger; and a sliding sleeve configured to translate axially from a first position in which the sleeve prevents a flow of fluid cement through the fluid passageways to a second position in which the sleeve does not prevent the flow of fluid cement through the fluid passageways; and actuating, by the running tool, the liner hanger by engaging slips of the liner hanger against the inner surface of the first liner string to prevent axial movement of the integrated liner hanger assembly;

cementing the second liner string in the wellbore by a cementing job comprising flowing cement into an annulus between the second liner string and the wellbore;

actuating, by the running tool, the liner top packer assembly, thereby isolating a volume of the annulus uphole of the liner top packer assembly from a volume of the annulus downhole of the actuating the liner top packer assembly;

axially translating, by the running tool, the sliding sleeve from the first position to the second position; and flowing the fluid cement through the fluid passageways and thereby at least partially filling a cement void or leak in the volume of the annulus downhole of the liner top packer assembly, said void or leak unfilled by the cement of the cementing job.

22. The method of claim 21, wherein at least some of the plurality of fluid passageways comprise a one-way valve configured to prevent a flow of fluid from the annulus to the central bore and to allow a flow of fluid from the central bore to the annulus if a fluid pressure within the central bore exceeds an opening pressure of the one-way valve.

23. The method of claim 21, wherein the plurality of fluid passageways are positioned circumferentially around the cement retainer sub.

24. The method of claim 21, wherein the actuating of the packer assembly comprises axially raising the running tool in an uphold direction and then lowering the running tool such that a first subset of a plurality of setting dogs of the running tool engage against a landing shoulder of the packer assembly.

25. The method of claim 24, wherein axially translating the sliding sleeve from the first position to the second position comprises, after actuating the packer assembly, axially raising the running tool in an uphole direction such that a second subset of the plurality of setting dogs engages against a first landing shoulder of the sliding sleeve.

26. The method of claim 25, wherein the sliding sleeve is further configured to translate axially to a third position in which the sleeve prevents a flow of fluid cement through the fluid passageways and in which the sliding sleeve is locked so as to prevent further axial movement of the sliding sleeve, and wherein a sliding of the sliding sleeve from the second position to the third position comprises, after axially translating the sliding sleeve from the first position to the second position, axially lowering the running tool in an downhole direction such that a third subset of the plurality of setting dogs engages against a second landing shoulder of the sliding sleeve.

27. The method of claim 26, wherein the steps of (a) running the integrated liner hanger assembly and the second liner string into the wellbore, (b) actuating the liner hanger, (c) actuating the packer assembly, (d) axially translating the sliding sleeve between the first position to the second position, and (e) axially translating the sliding sleeve between the second position to the third position, are completed in a single trip of the running tool into and out of the wellbore.

* * * * *